US007322747B2

(12) United States Patent
Borchardt

(10) Patent No.: US 7,322,747 B2
(45) Date of Patent: Jan. 29, 2008

(54) LEAK PROOF CLOSURE DEVICE WITH SPRING MEMBER

(75) Inventor: Michael G. Borchardt, Naperville, IL (US)

(73) Assignee: The Glad Products Company, Oakland, CA (US)

( * ) Notice: Subject to any disclaimer, the term of this patent is extended or adjusted under 35 U.S.C. 154(b) by 428 days.

(21) Appl. No.: 10/882,000

(22) Filed: Jun. 29, 2004

(65) Prior Publication Data

US 2005/0286813 A1 Dec. 29, 2005

(51) Int. Cl.
*B65D 33/16* (2006.01)

(52) U.S. Cl. ..... 383/63; 383/61.2; 24/585.12; 24/30.5 R

(58) Field of Classification Search ..... 383/61.2, 383/63, 64, 59; 24/585.12, DIG. 50, 400
See application file for complete search history.

(56) References Cited

U.S. PATENT DOCUMENTS 3,806,998 A 4/1974 Laguere
4,362,198 A * 12/1982 Kamp ..... 383/63
4,710,968 A 12/1987 Borchardt et al.
4,778,282 A 10/1988 Borchardt et al.
4,854,017 A * 8/1989 Kamp ..... 24/585.12
4,907,321 A * 3/1990 Williams ..... 24/585.12
5,007,143 A 4/1991 Herrington
5,192,135 A * 3/1993 Woods et al. ..... 383/63
5,198,055 A * 3/1993 Wirth et al. ..... 156/66
5,248,201 A 9/1993 Kettner et al.
5,293,672 A * 3/1994 Tominaga et al. ..... 24/585.1
5,509,734 A * 4/1996 Ausnit ..... 383/63
5,664,299 A 9/1997 Porchia et al.
5,689,866 A 11/1997 Kasai et al.
6,009,603 A * 1/2000 Gallagher ..... 24/585.12
6,074,096 A * 6/2000 Tilman ..... 383/63
6,167,597 B1 1/2001 Malin
6,632,021 B2 * 10/2003 Bois et al. ..... 383/59
2003/0219174 A1 * 11/2003 Piechocki ..... 383/59
2004/0001650 A1 * 1/2004 Piechocki et al. ..... 383/59

* cited by examiner

*Primary Examiner*—Nathan J. Newhouse
*Assistant Examiner*—Jack Morgan
(74) *Attorney, Agent, or Firm*—Thomas C. Feix

(57) ABSTRACT

A closure device includes a spring member to increase the sealing action of the closure device. The closure device is particularly suitable for use with flexible containers. The closure device includes a male and a female closure element that include male and female hook portions, respectively. The male and female hook portions interlockingly engage with one another to provide a leak proof seal for the flexible container. The spring member is attached to one of the closure elements and acts upon the hook portions of the other closure element to increase the sealing action of the closure device.

59 Claims, 17 Drawing Sheets

LEAK PROOF CLOSURE DEVICE WITH SPRING MEMBER

FIELD OF THE INVENTION

The present invention relates generally to a closure device and, more particularly, to a resealable leak proof closure device with a spring member. The invention is particularly well suited for fastening flexible storage containers, including plastic bags.

BACKGROUND OF THE INVENTION

The use of closure devices for closure of containers, including plastic bags, is generally well known. The closure device and the associated container are formed, typically, from thermoplastic materials. The manufacture of closure devices by extrusion is generally known to those skilled in the art of closure devices. Closure devices are generally either extruded and then attached to the container or integrally formed with the container.

These devices are resealable, which allows the container to be reused. In general, a closure device provides relatively high resistance to opening from interior the container while rendering the container relatively easy to open from the exterior. However, in certain circumstances, it may be desirable for a closure device to provide high resistance to opening from the exterior as well.

The interior of the container may be under relatively high pressure or relatively low pressure because of varying internal contents and external environments. To provide the appropriate resistance to opening from the interior or exterior and to keep the container closed, closure devices typically use a combination of interlocking hooks. In some closure devices, the contact surfaces between the interlocking hooks provide the primary seal for the container. One difficulty with this design may be providing a secure closure and an air tight or leak proof seal while maintaining a closure that is easy to occlude as well as open from the exterior. On occasion it may occur that the interlocking hooks may not contact each other, yet remain occluded, because of slight variations in the hooks or because the conditions under which the closure device is used cause the hooks to not contact each other as shown in FIG. 33. If, while in an occluded position, the interlocking hooks are not intimately mated, the closure device may not adequately provide an air tight or leak proof seal.

BRIEF SUMMARY OF THE INVENTION

In view of the above, the present invention provides an improved closure device for flexible containers. More particularly, the present invention is directed to a closure device that provides improved sealing action for a flexible container, a container including such a closure device and a method of manufacturing the closure device.

In accordance with the present invention, the closure device provides male and female closure elements that interlockingly engage with one another and extend a predetermined length. Typically, this length is the width of the flexible container to which the closure device is designed to apply. Both the male and the female closure elements include hook portions that facilitate the interlocking engagement of the closure device while in an occluded position. Furthermore, at least one of the closure elements includes a spring member to facilitate the sealing action of the closure device. The spring member increases the seal of the closure device by increasing the contact forces between the interlocking hook portions causing the hook portions to more intimately mate. It also increases the sealing action by creating an additional contact surface that creates an additional impediment that restricts the contents of the container from leaking therefrom.

In accordance with another embodiment of the disclosed invention, the closure device may include multiple spring members. These additional spring members may be attached to either the male or female closure elements. By providing additional spring members, the closure elements are more securely interlockingly engaged and more contact surfaces are provided to restrict the contents of the bag from leaking therefrom.

These and other features and advantages of the invention will be more readily apparent upon reading the following description of the invention and upon reference to the accompanying drawings

DETAILED DESCRIPTION OF THE INVENTION

Figure 1:
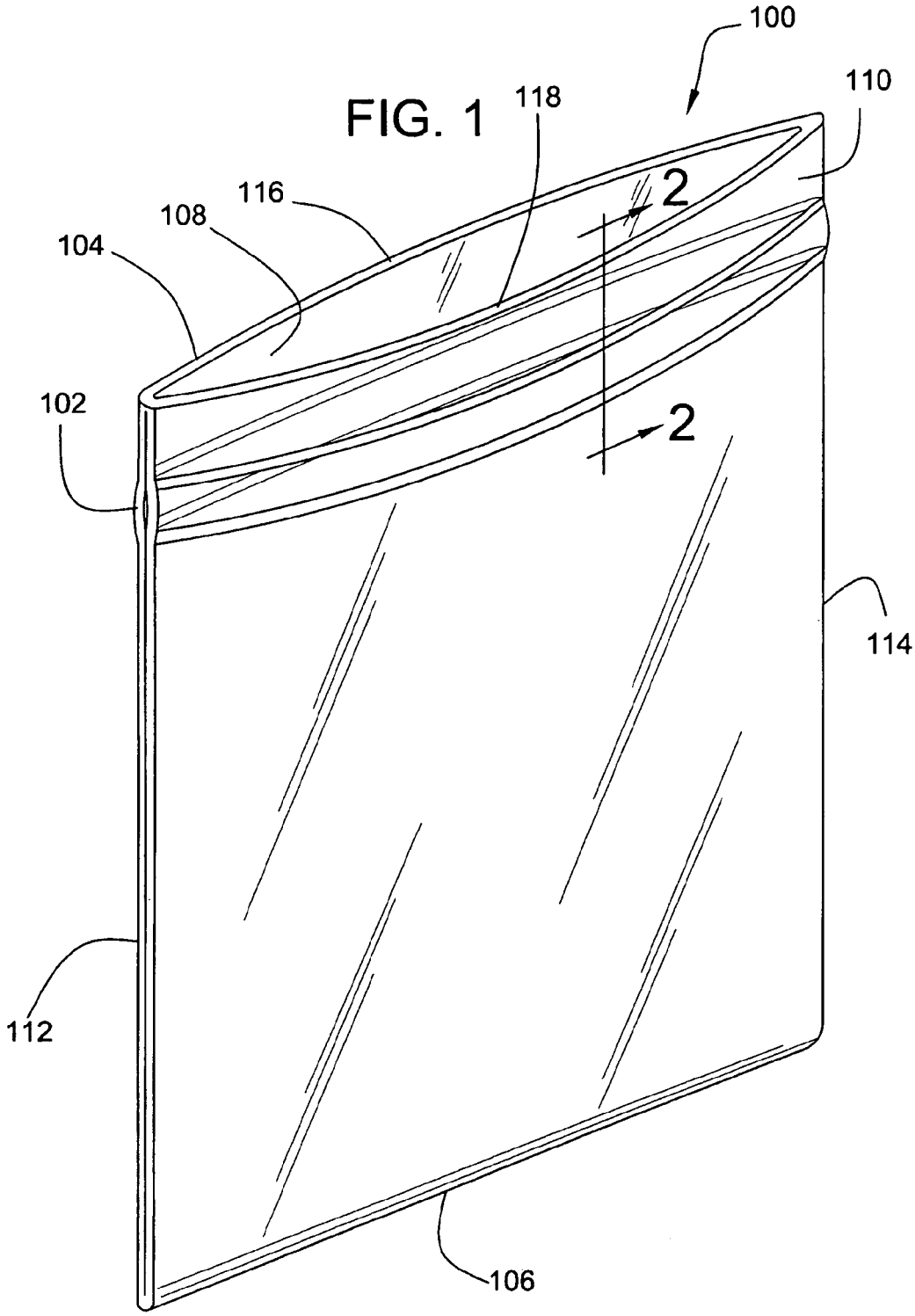
FIG. 1 is a perspective view of a flexible container including a closure device in accordance with the invention.

FIG. 1 illustrates a flexible container according to the present invention in the form of a plastic bag 100 including a sealable longitudinally extending closure device 102. The closure device 102 extends substantially the width of the bag 100. The bag 100 is formed from a thin plastic film 104 which is U-folded at the bottom 106 of the bag 100. The film 104 establishes sidewalls 108, 110 for the container. Typically, the sidewalls 108, 110 are heat sealed at vertical edges 112, 114, thereby forming a container. The ends of the closure device 102 are heat sealed. The sidewalls 108, 110 extend beyond the closure device 102 to provide mouth portions 116, 118 to simplify opening of the bag 100 and, more particularly, the closure device 102. The entire closure device 102 is typically occluded by beginning at one edge of the bag and working toward the other edge of the bag such as, from edge 112 to edge 114.

Figure 2:
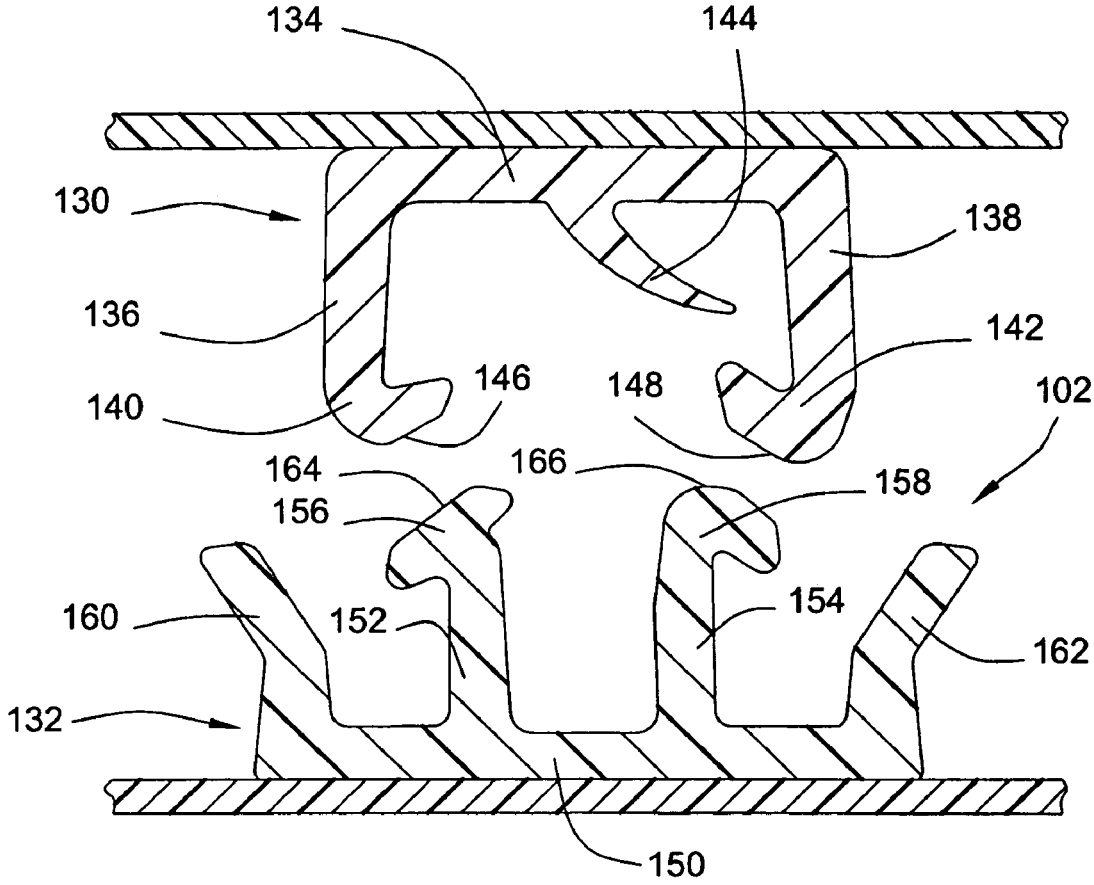
FIG. 2 is a cross-sectional view taken along line 2-2 of FIG. 1 of one embodiment of a closure device in accordance with the invention, shown in a non-occluded position.

FIG. 2 is a cross-sectional illustration of a leak proof closure device 102 in accordance with one embodiment of the present invention, shown in a non-occluded position. The closure device 102 comprises female and male closure elements 130, 132, which interlockingly engage over a predetermined length. The female and male closure elements 130, 132 may be extruded and then attached to a side wall of a container.

The female closure element 130 includes a base portion 134, a pair of spaced-apart, parallely disposed webs 136, 138, a pair of female hook portions 140, 142, and a spring member 144. The webs 136, 138 extend from the base portion 134 and include and terminate in the female hook portions 140, 142, respectively. The female hook portions 140, 142 extend toward one another. The female hook portions 140, 142 include guide surfaces 146, 148 which serve to guide the female closure element 130 and, more particularly, the female hook portions 140, 142 during occlusion of the female and male closure elements 130, 132. The spring member 144 extends from the base portion 134. Typically, the base portion 134, the webs 136, 138, and the spring member 144 of the female closure element 130 are integrally formed in a unitary body.

The male closure element 132, which is adapted to interlockingly engage and mate with the female closure element 130, includes a base portion 150, a pair of spaced-apart, parallely disposed webs 152, 154, a pair of male hook portions 156, 158 and a pair of spaced-apart, parallely disposed guide wings 160, 162. The webs 152, 154 extend from the base portion 150 and include and terminate in the male hook portions 156, 158, respectively. The male hook portions 156, 158 extend away from one another and are adapted to engage the female hook portions 140, 142, respectively. The male hook portions 156, 158 include guide surfaces 164, 166 which serve to guide the male closure element 132 and, more particularly, the male hook portions 156, 158 during occlusion of the female and male closure elements 130, 132. The guide wings 160, 162 extend from the base portion 150 and are disposed parallel to the webs 152, 154. Typically, the base portion 150, webs 136, 138, and guide wings 160, 162 of the male closure element 132 are integrally formed in a unitary body.

Figure 3:
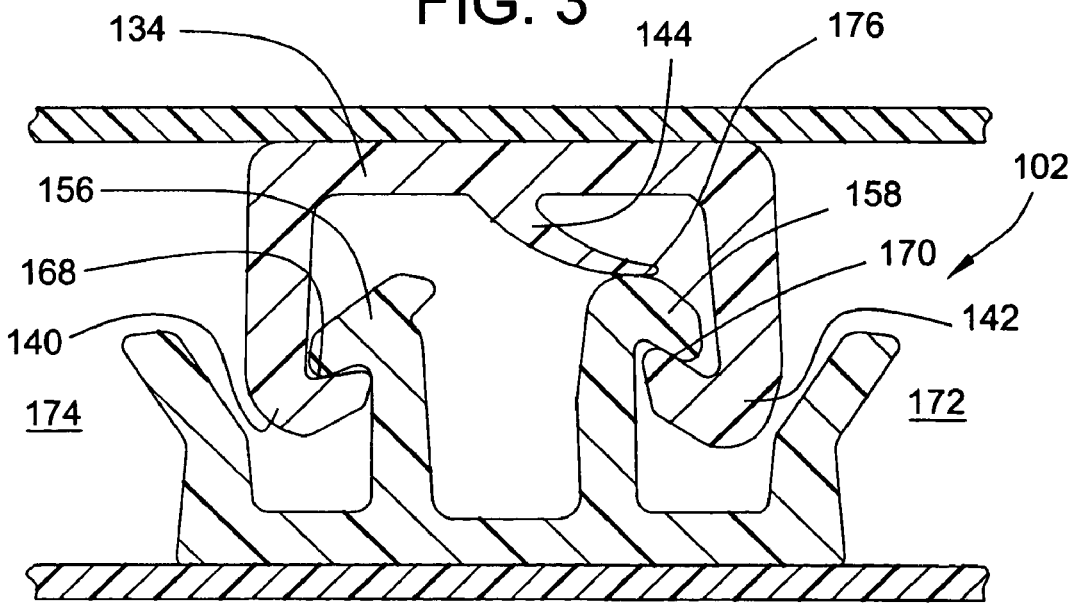
FIG. 3 is a cross-sectional view of the closure device of FIG. 2, shown in an occluded position.
Figure 4:
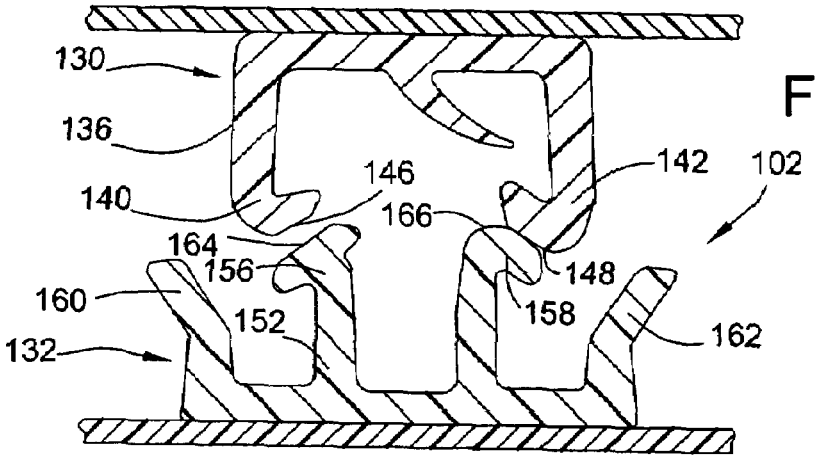
FIGS. 4-7 are cross-sectional views of the embodiment of the invention illustrated in FIG. 2 illustrating the typical occlusion sequence of the closure devices in accordance with the invention.

FIG. 3 illustrates the closure device 102 in FIG. 2, but shown in an occluded position. In the occluded position, the female hook portions 140, 142 interlockingly engage the male hook portions 156, 158. Particularly, female hook portion 140 engages male hook portion 156, generally, at contact surface 168 and female hook portion 142 engages male hook portion 158, generally, at contact surface 170. Contact forces between the engaged hook portions resist opening the container. Furthermore, the contact surfaces 168, 170, where the hook portions engage one another, provide seals for closure device 102.

In the occluded position, the closure device 102 defines an interior 172 and an exterior 174 of a container. In this embodiment, the spring member 144 extends towards the interior 172 of the container. As illustrated, the spring member 144 is curved. It should be noted that the spring member may have other shapes. For example, in the non-occluded position, the spring member may be a substantially straight member or a "z-shaped" member. The spring member 144, which extends from the base portion 134 of the female closure element 130, acts upon the male hook portion 158, which is adjacent the interior 172 of the container. By acting on the male hook portion 158, the spring member 144 forces the male hook portion 158 against the female hook portion 142, which the male hook portion 158 engages. In addition, by acting on the male hook portion 158, the spring member 144 causes the female hook portion 142 to be drawn toward the male hook portion 158. Together these actions cause a more intimate mating and sealing of male hook portion 158 and the female hook portion 142 at contact surface 170. As well as increasing the seal at contact surface 170, the spring member 144 provides an additional seal at contact surface 176, which is where the spring member 144 acts upon the male hook portion 158. Thus, the spring member 144 substantially increases the sealing action of the closure device 102 while in the occluded position by increasing the sealing action at contact surface 170 as well as providing an additional seal at contact surface 176. As disclosed below in other embodiments of the invention, additional spring members may be added to the closure device. These additional spring members provide additional contact surfaces that act as seals by restricting the contents of the bag and preventing them from leaking. The spring members also improve the sealing action between the interlockingly engaged male and female hook portions by improving the engagement of the closure elements.

FIGS. 4-7 illustrate the general occlusion sequence of a closure device 102 according to the present invention. FIG.

4 illustrates the beginning of the occlusion sequence, wherein the guide surfaces 146, 148 of the female hook portions 140, 142 and the guide surfaces 164, 166 of the male hook portions 156, 158 begin to contact. Particularly, guide surface 146 of female hook portion 140 and guide surface 164 of male hook portion 156 begin to contact one another. Guide surface 148 of female hook portion 142 and guide surface 166 of male hook portion 158 begin to contact one another. If the female and male closure elements 130, 132 are not aligned properly at this time, the guide wings 160, 162 assist in aligning the closure elements 130, 132 for proper occlusion.

Figure 5:
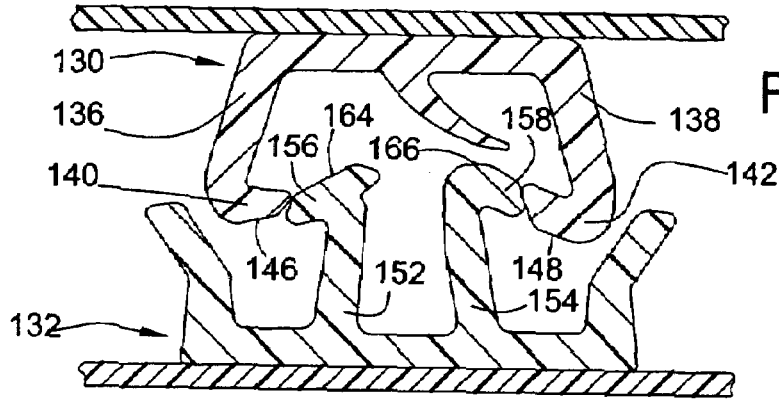

In FIG. 5, the female and male closure elements 130, 132 have begun to be pressed together. As the closure elements 130, 132 come closer together, the guide surfaces 146, 148 of the female hook portions 140, 142, respectively, begin to slide relative to the guide surfaces 164, 166 of the male hook portions 156, 158, respectively. In addition, the webs 136, 138 of the female closure element 130 begin to deflect resiliently away from one another, while the webs 152, 154 of the male closure element 132 begin to deflect resiliently toward one another.

Figure 6:
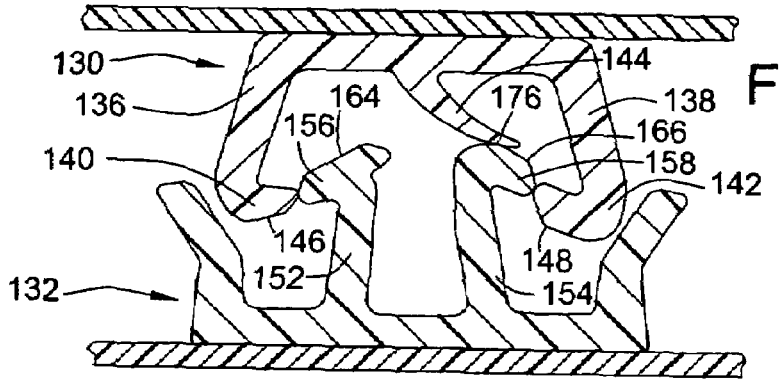

In FIG. 6, the female and male closure elements 130, 132 are pressed closer together, as compared to FIG. 5. The guide surfaces 146, 148 of the female hook portions 140, 142, respectively, continue to slide relative to the guide surfaces 164, 166 of the male hook portions 156, 158, respectively. Webs 136, 138 of the female closure element 130 increasingly deflect resiliently away from one another. The webs 152, 154 of the male closure element 132 increasingly deflect resiliently toward one another. Furthermore, as the male and female closure elements 130, 132 continue towards one another, the spring member 144 begins to contact the guide surface 166 of the male hook portion 158 at contact surface 176.

Figure 7:
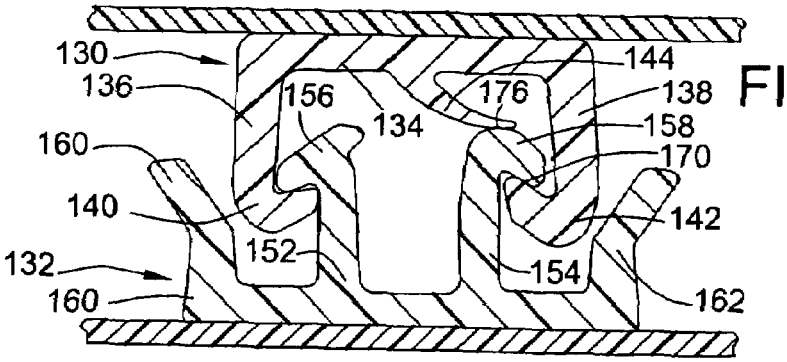

In the occluded position illustrated in FIG. 7, the female and male closure elements 130, 132 are interlockingly engaged. In this position, the female hook portions 140, 142 substantially engage the male hook portions 156, 158, respectively. Furthermore, the webs 136, 138 of the female closure element 130 and the webs 152, 154 of the male closure element 132 return to a substantially un-deflected state that is substantially similar to the un-deflected state in FIG. 4. However, it should be noted that some deflection of the webs may exist in the occluded position.

In this occluded position, the spring member 144 is deflected resiliently substantially towards the base portion 134 of the female closure element 130. The resilient deflection of the spring member 144 causes the spring member 144 to act upon the male hook portion 158 at contact surface 176 and forcing male hook portion 158 into female hook portion 142, thereby providing an increased sealing action at contact surface 170. The contact surface 176 between the spring member 144 and the male hook portion 158, also, provides an additional seal.

The guide wings 160, 164 of the male closure element 132 assist the occlusion of the female and male closure elements 130, 132. The guide wings 160, 164 may be provided as outer alignment members that guide and funnel the female and male closure elements 130, 132 toward one another during occlusion.

Figure 8:
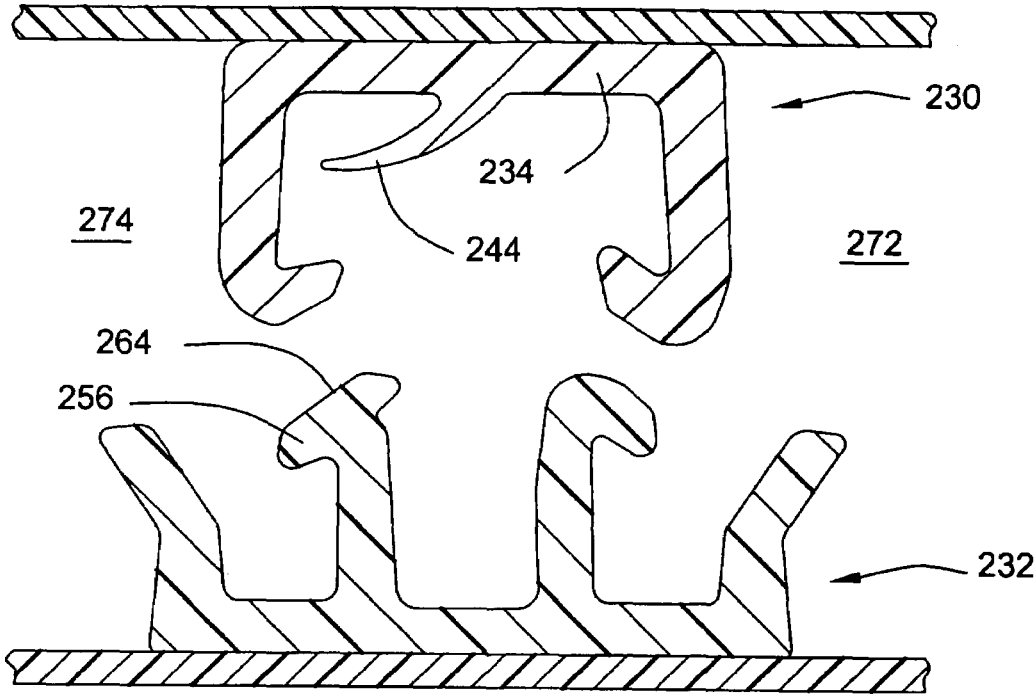
FIG. 8 is a cross-sectional view of another embodiment of the closure device, shown in a non-occluded position.
Figure 9:
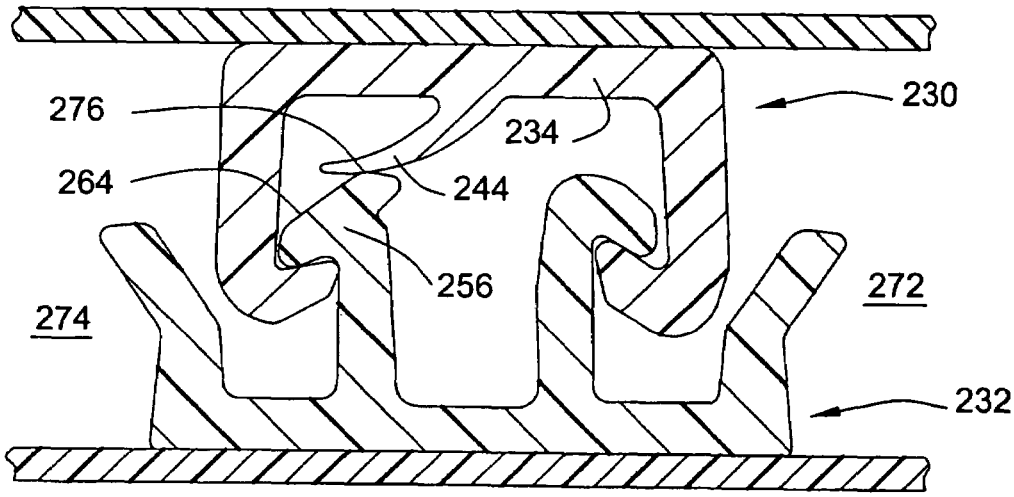
FIG. 9 is a cross-sectional view of the closure device of FIG. 8, shown in an occluded position.

FIGS. 8 and 9 illustrate another embodiment of the claimed invention in the non-occluded and occluded positions, respectively. This disclosed embodiment is similar to the embodiment in FIGS. 2 and 3. However, in this embodiment, the spring member 244 that extends from the base portion 234 of the female closure element 230 extends towards the exterior 274 of the container. As best seen in FIG. 9, the spring member 244 acts upon a male hook portion 256 adjacent to the exterior 274 of the container while in the occluded position. Particularly, the spring member 244 acts upon guide surface 264 at contact surface 276.

Figure 10:
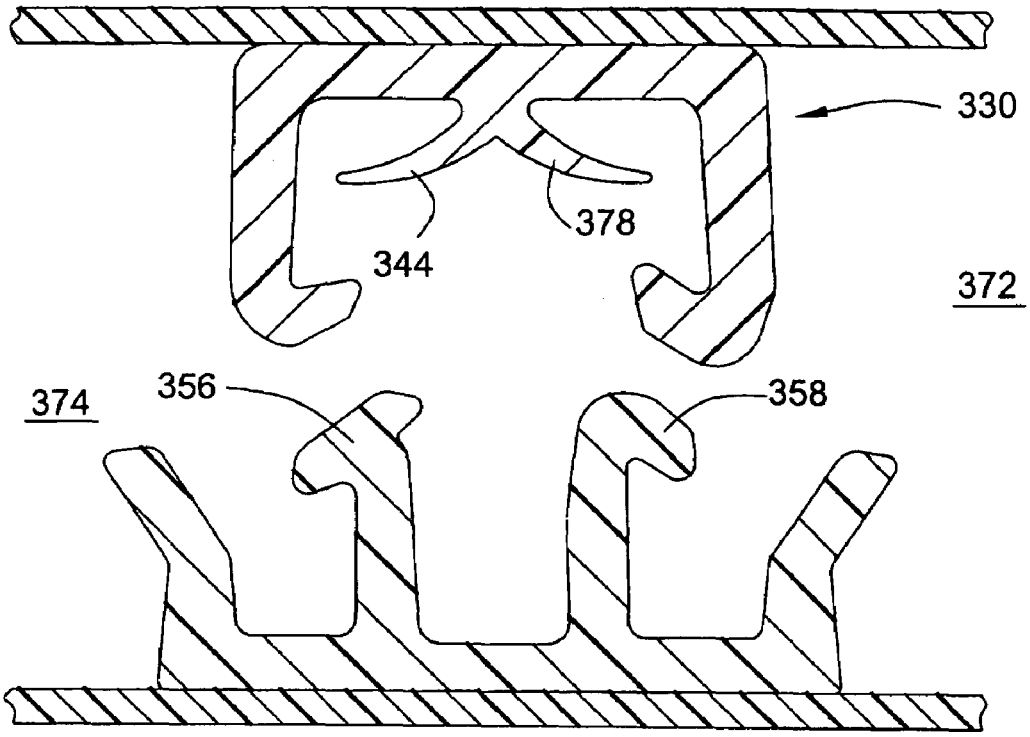
FIG. 10 is a cross-sectional view of another embodiment of the closure device, shown in a non-occluded position.
Figure 11:
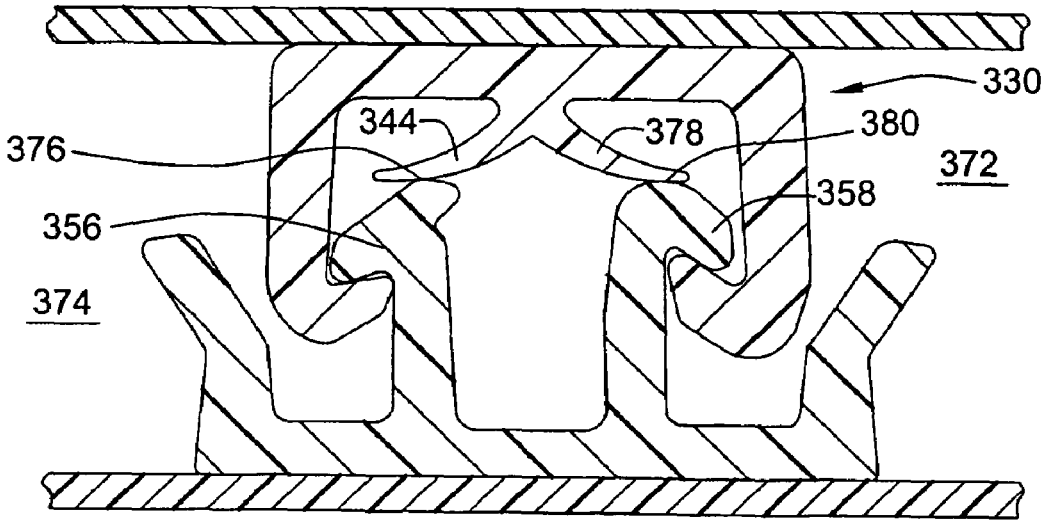
FIG. 11 is a cross-sectional view of the closure device of FIG. 10, shown in an occluded position.

FIGS. 10 and 11 illustrate a further embodiment of a closure device in accordance with the invention in the non-occluded and occluded positions, respectively. This embodiment is similar to and is a combination of the embodiments in FIGS. 2 and 8. In this embodiment, two spring members 344, 378 extend from the base portion 334 of the female closure element 330. As best illustrated in FIG. 11, spring member 344 acts upon the male hook portion 356 adjacent to the exterior 374 of the container at contact surface 376. Spring member 378 acts upon the male hook portion 358 adjacent to the interior 372 of the container at contact surface 380.

Figure 12:
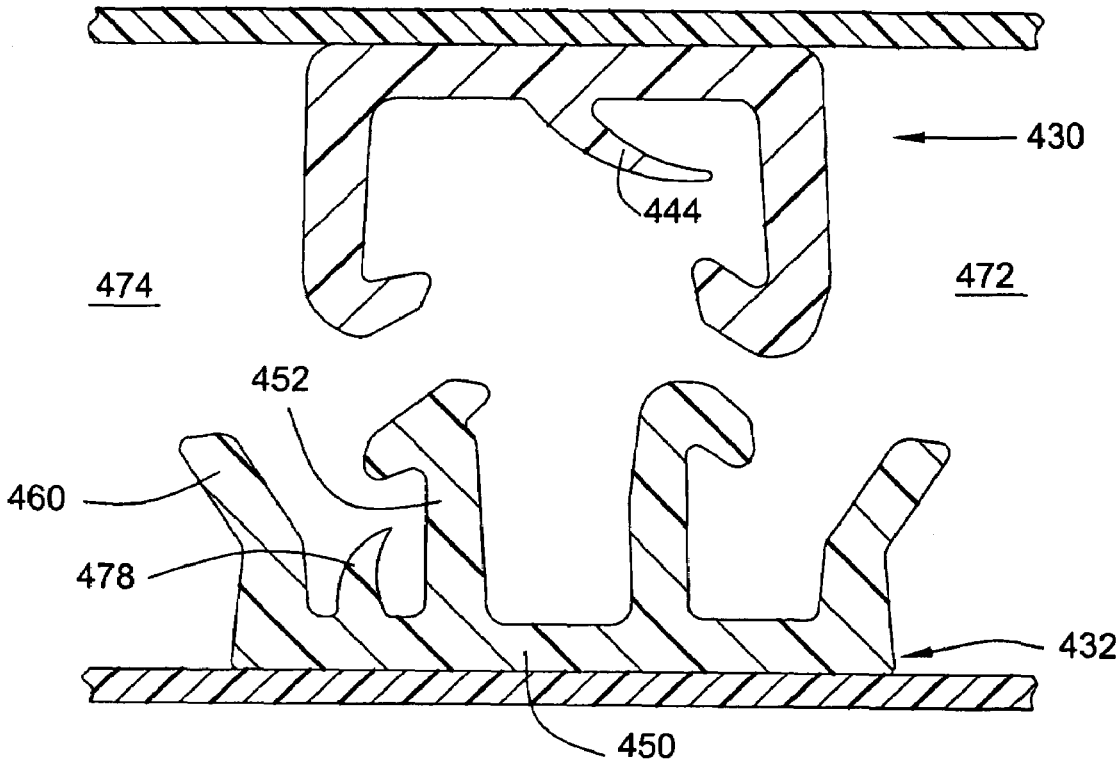
FIG. 12 is a cross-sectional view of another embodiment of the closure device, shown in a non-occluded position.

FIG. 12 illustrates a further embodiment of the claimed invention, shown in a non-occluded position. In FIG. 12, the female closure element 430 includes spring member 444 and is similar to that disclosed in FIG. 2. The male closure element 432 of this embodiment includes a spring member 478 that extends from base portion 450. The spring member 478 is disposed between and is substantially parallel to the web 452 and the guide wing 460 that are adjacent to the exterior 474 of a container.

Figure 13:
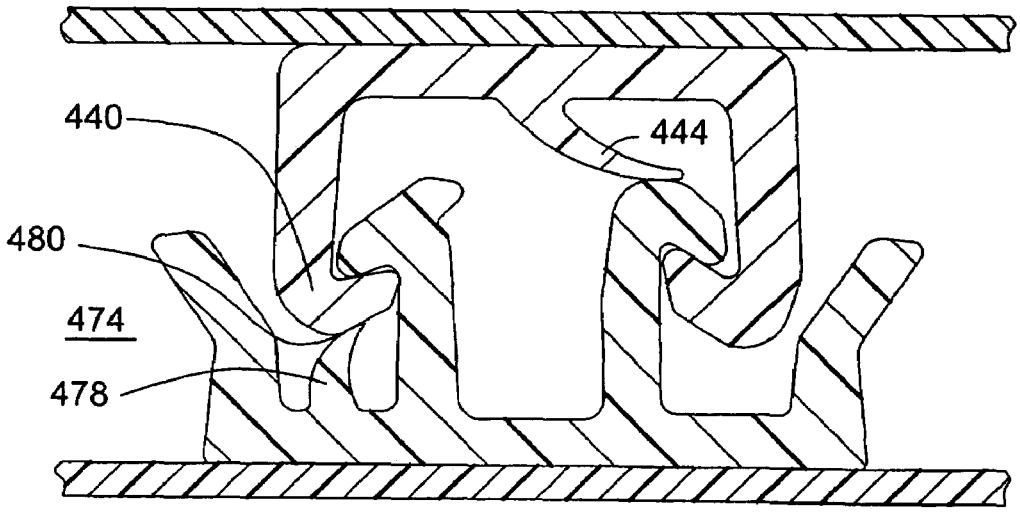
FIG. 13 is a cross-sectional view of the closure device of FIG. 12, shown in an occluded position.

FIG. 13 illustrates the embodiment in FIG. 12 in the occluded position. As illustrated, the spring member 478 extends towards the interior 472 of the container and it is integrally attached to the base portion 450. In this embodiment, the spring member 478 acts upon the female hook portion 440 adjacent to the exterior 474 of the container.

Figure 14:
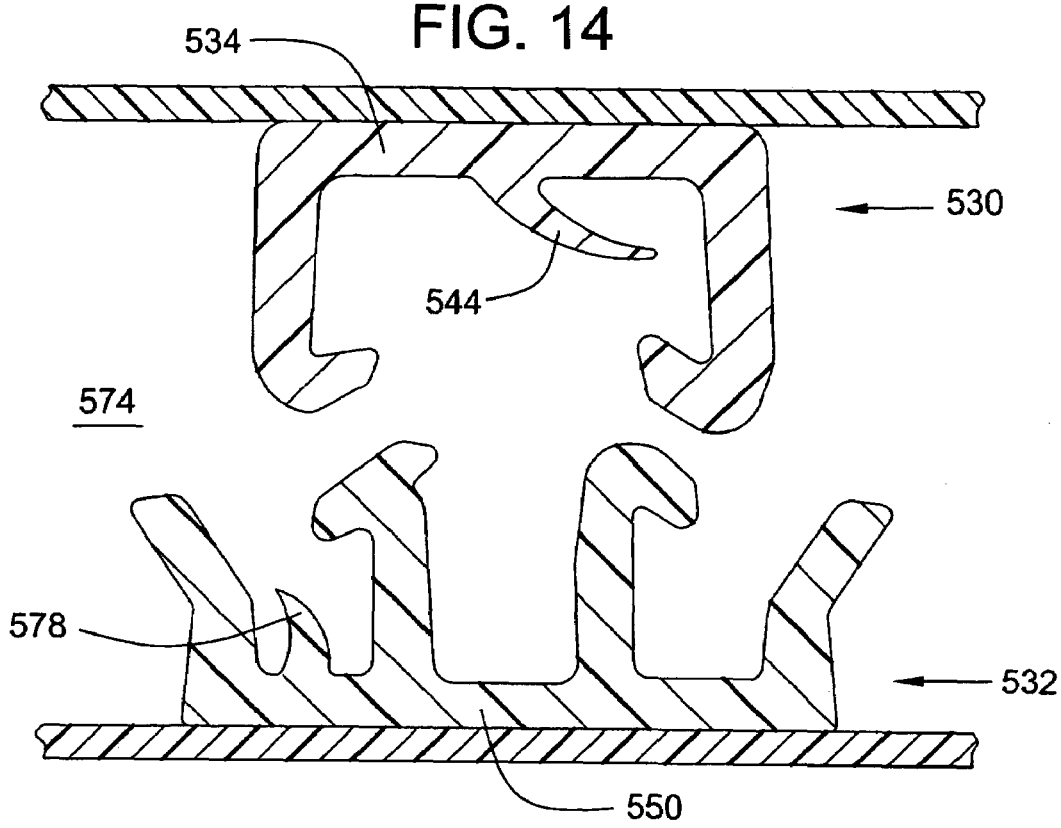
FIG. 14 is a cross-sectional view of another embodiment of the closure device, shown in a non-occluded position.
Figure 15:
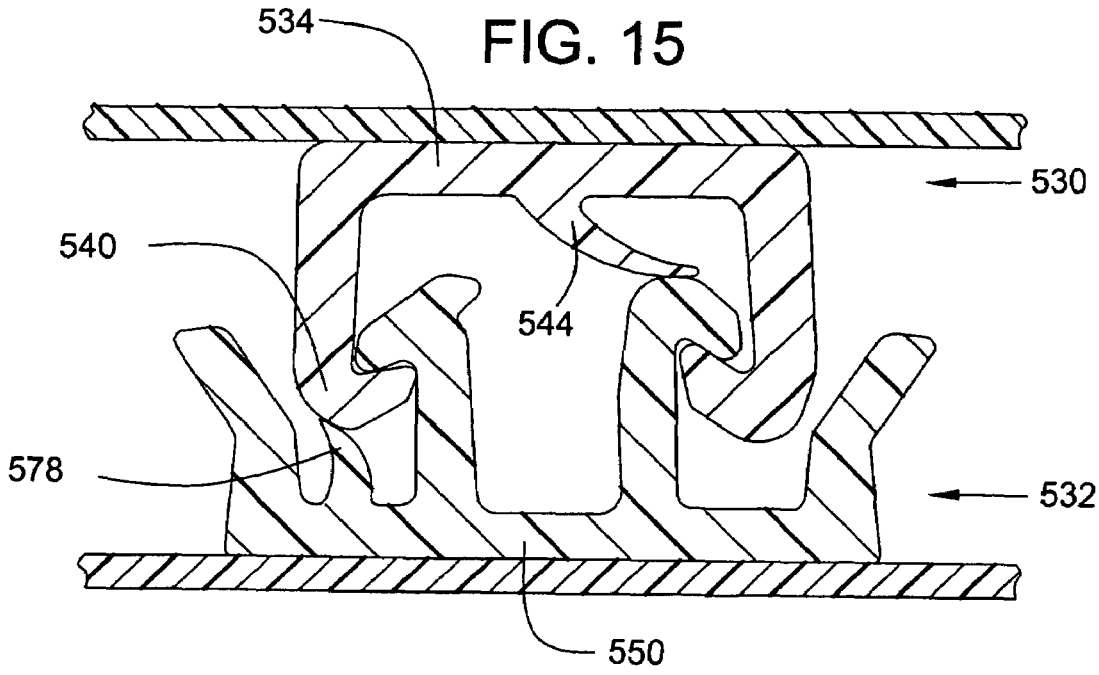
FIG. 15 is a cross-sectional view of the closure device of FIG. 14, shown in an occluded position.

FIGS. 14 and 15 illustrate a further embodiment of the claimed invention, shown in a non-occluded and an occluded position, respectively. This embodiment is similar to the embodiment in FIGS. 12 and 13. This other embodiment similarly includes a spring member 544 that extends from the base portion 534 of the female closure element 530. However, the spring member 578 that extends from the base portion 550 of the male closure element 532 extends towards the exterior 574 of the container. Similar to the embodiment in FIG. 13, the spring member 578 in this embodiment acts upon the female hook portion 540 adjacent to the exterior 574 of the container.

Figure 16:
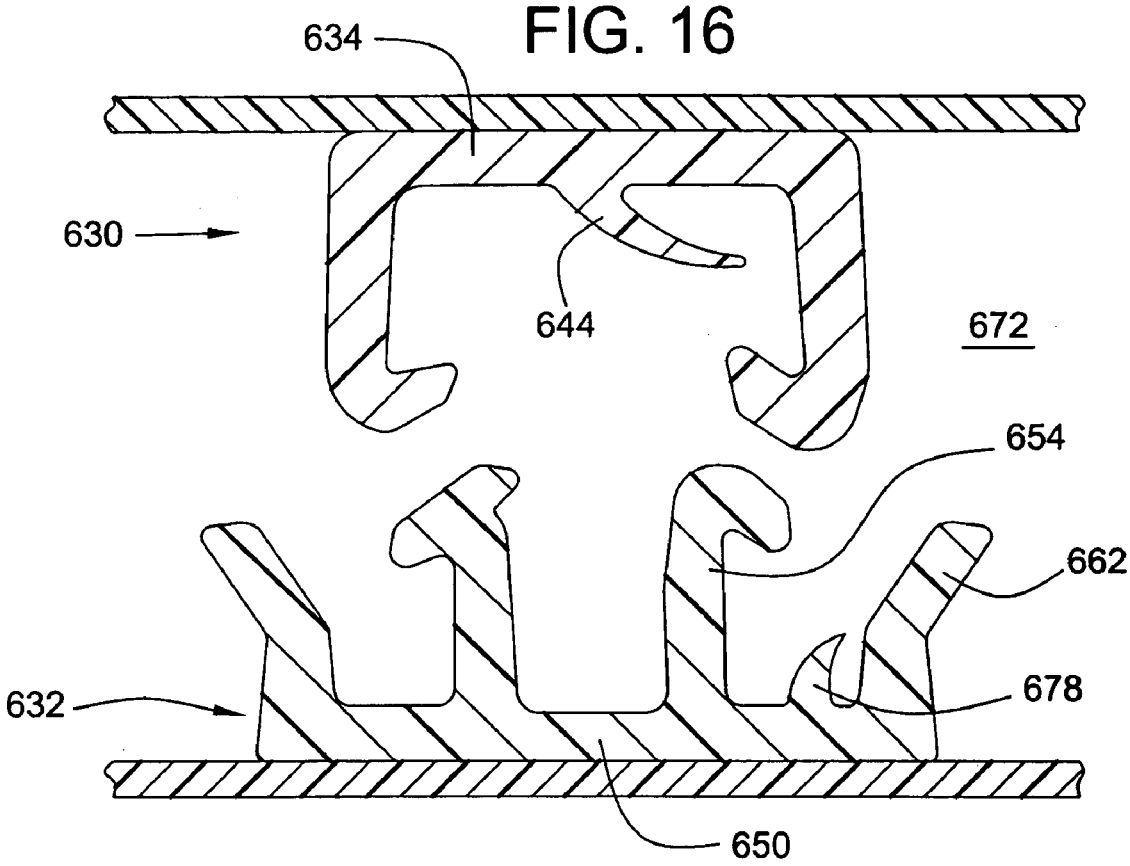
FIG. 16 is a cross-sectional view of another embodiment of the closure device, shown in a non-occluded position.
Figure 17:
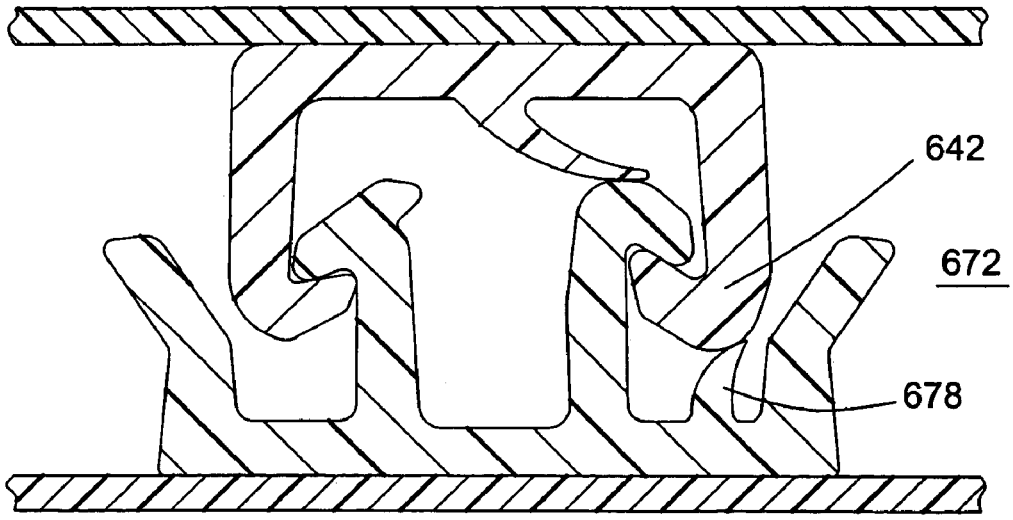
FIG. 17 is a cross-sectional view of the closure device of FIG. 16, shown in an occluded position.

FIG. 16 illustrates a further embodiment of a closure device of the claimed invention, shown in a non-occluded position. This embodiment is similar to the embodiment in FIG. 12, except for the positioning of the spring member 678. This embodiment similarly includes a spring member 644 that extends from the base portion 634 of the female closure element 630. As seen in FIG. 16, the male closure element 632 of this embodiment includes a base portion 650 and a spring member 678 that extends from the base portion 650. The spring member 678 is disposed between and is substantially parallel to the web 654 and the guide wing 662 that are adjacent to the interior 674 of the container. The spring member 678 extends towards the interior 672 of the container, and it is integrally attached to the base portion 650. FIG. 17 is an illustration of this embodiment in the occluded position. In this embodiment, the spring member 678 acts upon the female hook portion 642 adjacent to the interior 672 of the container.

Figure 18:
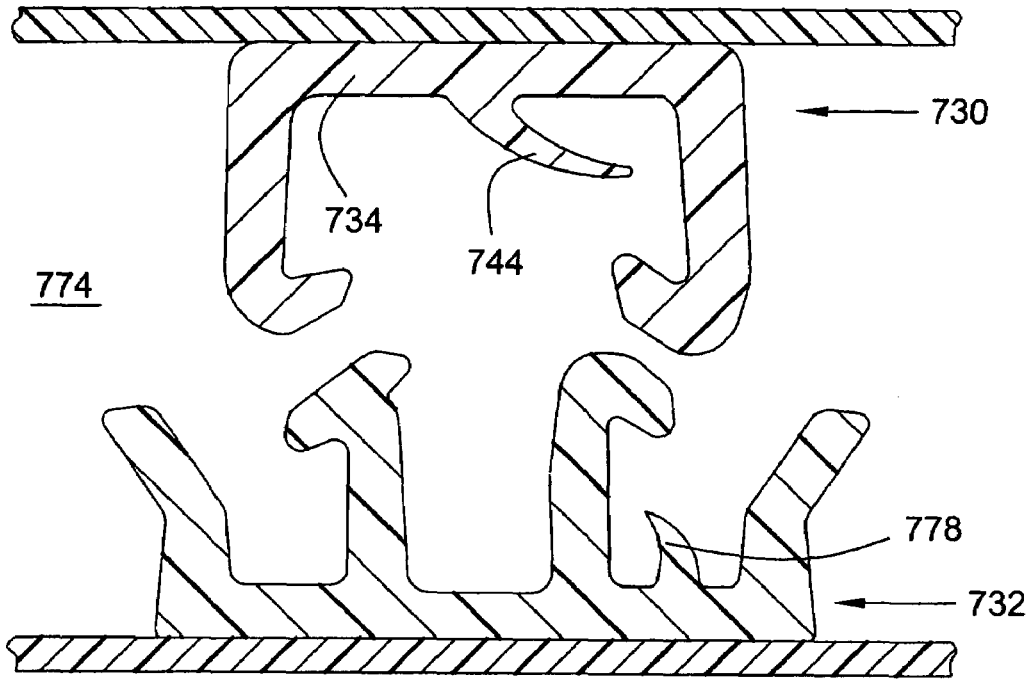
FIG. 18 is a cross-sectional view of another embodiment of the closure device, shown in a non-occluded position.
Figure 19:
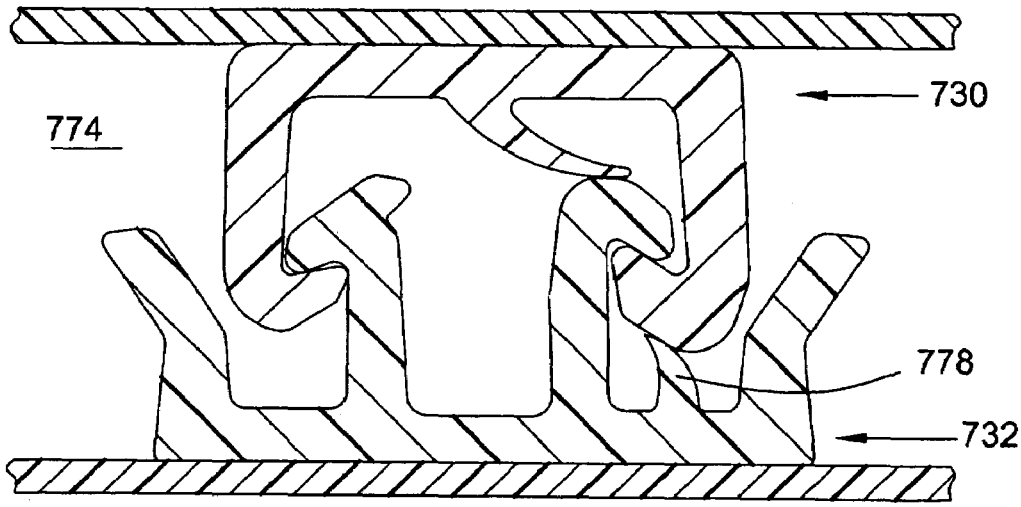
FIG. 19 is a cross-sectional view of the closure device of FIG. 18, shown in an occluded position.

FIGS. 18 and 19 illustrate another embodiment of the claimed invention, shown in a non-occluded and an occluded position, respectively. This embodiment is similar to the embodiment in FIGS. 16 and 17. This embodiment similarly includes a spring member 744 that extends from the base portion 734 of the female closure element 730. However, in this embodiment, the spring member 778 of the male closure element 732, extends towards the exterior 774 of the container.

Figure 20:
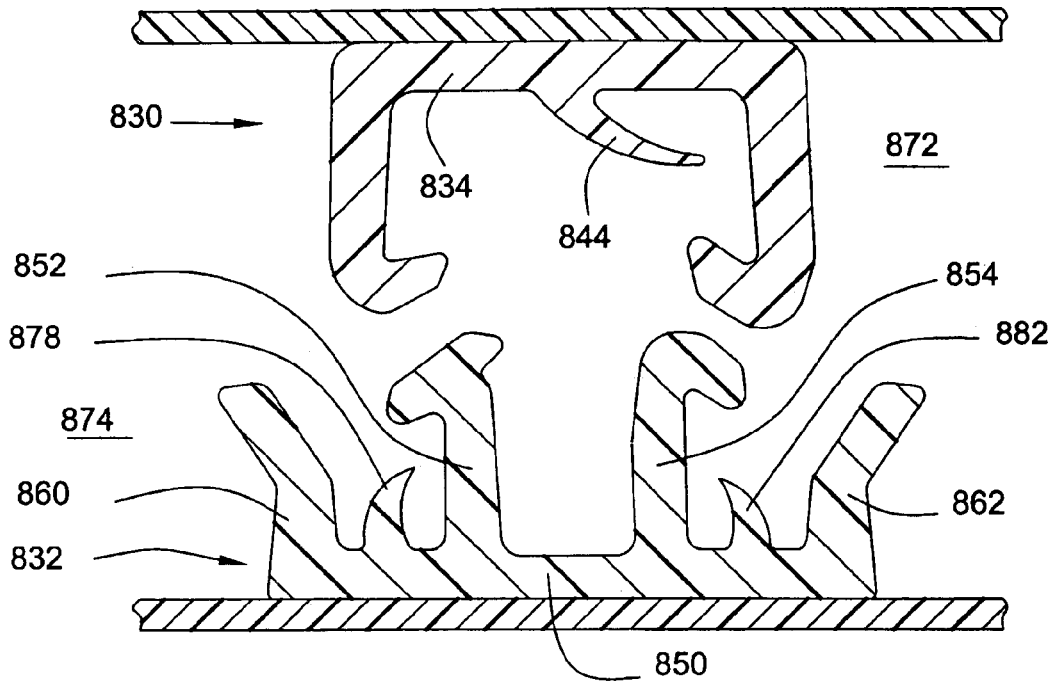
FIG. 20 is a cross-sectional view of another embodiment of the closure device, shown in a non-occluded position.

FIG. 20 illustrates a further embodiment of the claimed invention, shown in a non-occluded position. This embodiment is a combination of the embodiments in FIGS. 12 and 18. This embodiment similarly includes a spring member 844 that extends from the base portion 834 of the female closure element 830 and functions as explained previously. However, the male closure element 832 includes a base portion 850 and two spring members 878, 882 that extend toward one another and extend from the base portion 850. The first spring member 878 is disposed between and is substantially parallel to the web 852 and the guide wing 860, which are adjacent to the exterior 874 of the container. The second spring member 882 is disposed between and is substantially parallel to the web 854 and the guide wing 862, which are adjacent to the interior 872 of the container.

Figure 21:
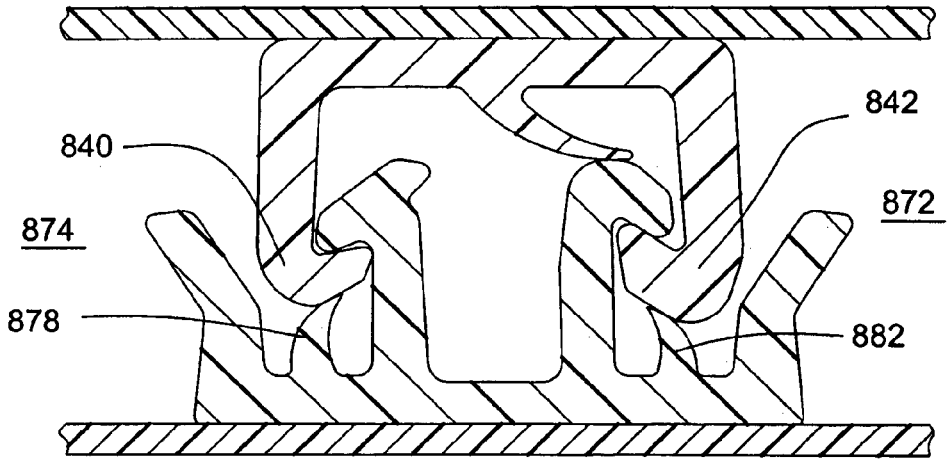
FIG. 21 is a cross-sectional view of the closure device of FIG. 20, shown in an occluded position.

FIG. 21 is an additional illustration of the embodiment in FIG. 20, shown in an occluded position. In this embodiment, the first spring member 878 acts upon a female hook portion 840 adjacent to the exterior 874 of the container. The second spring member 882 acts upon a female hook portion 842 adjacent to the interior 872 of the container.

Figure 22:
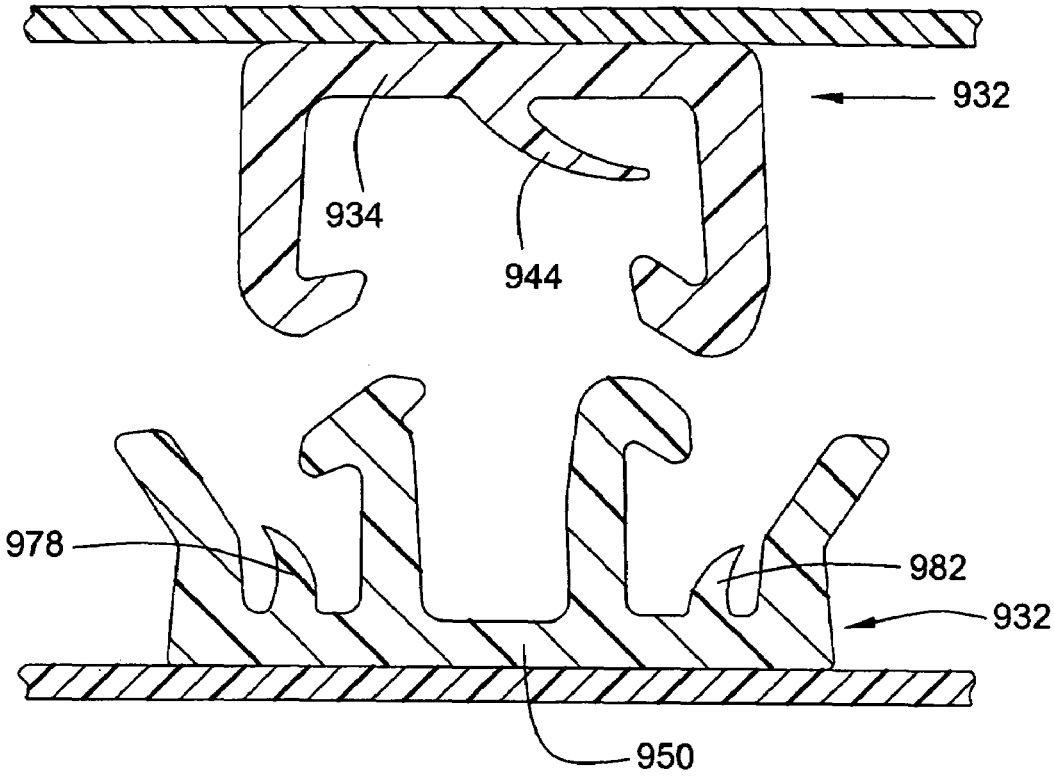
FIG. 22 is a cross-sectional view of another embodiment of the closure device, shown in a non-occluded position.
Figure 23:
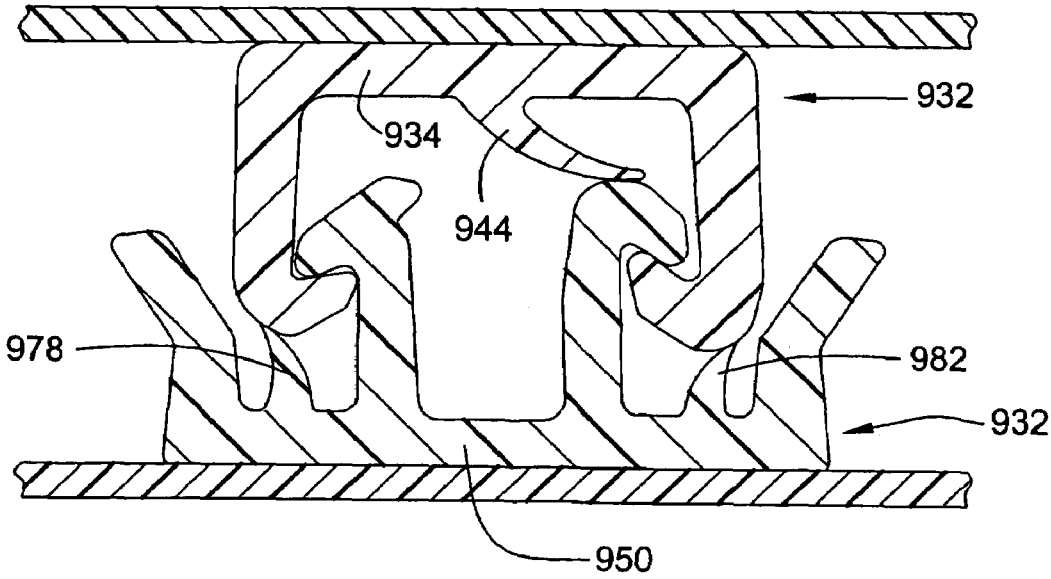
FIG. 23 is a cross-sectional view of the closure device of FIG. 22, shown in an occluded position.

FIGS. 22 and 23 illustrate a further embodiment of the disclosed invention, shown in a non-occluded and an occluded position, respectively. The embodiment is similar to the embodiment in FIGS. 20 and 21. This embodiment similarly includes a spring member 944 that extends from the base portion 934 of the female closure element 930. However, the spring members 978, 982 that extend from the base portion 950 of the male closure element 932 extend away from one another.

Figure 24:
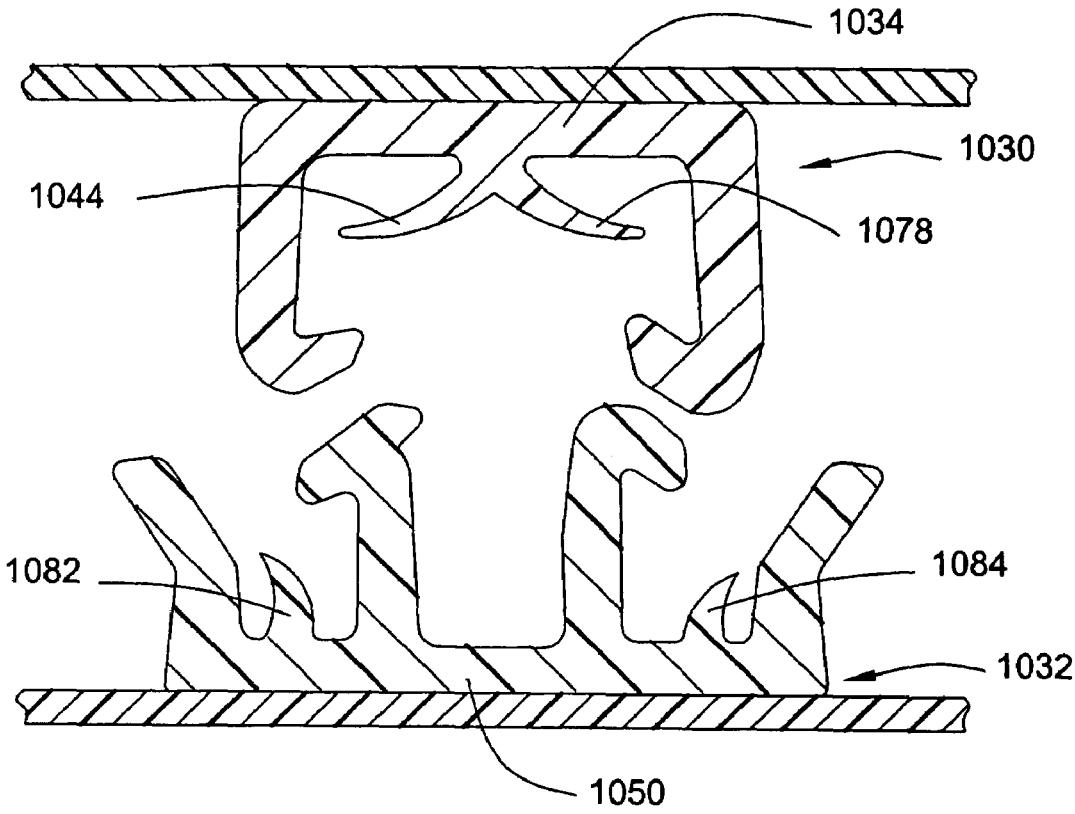
FIG. 24 is a cross-sectional view of another embodiment of the closure device, shown in a non-occluded position.
Figure 25:
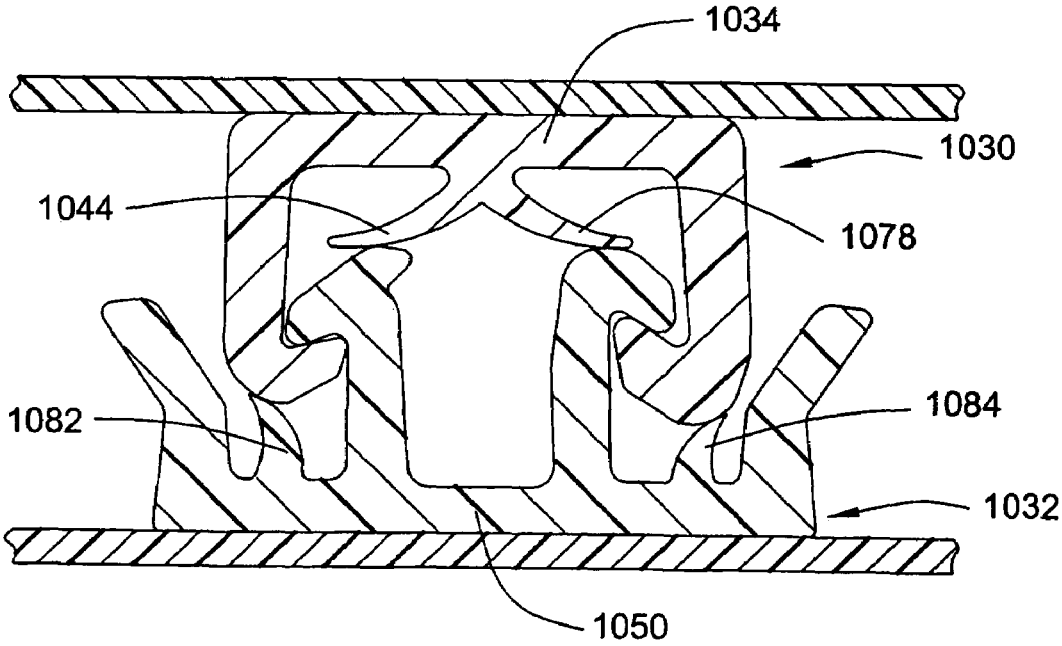
FIG. 25 is a cross-sectional view of the closure device of FIG. 24, shown in an occluded position.

FIGS. 24 and 25 illustrate a further embodiment of the disclosed invention, shown in a non-occluded and an occluded position, respectively. The embodiment is similar to and is a combination of the embodiments in FIGS. 10 and 22. The female closure element 1030 is the same as the female closure element 330 disclosed in FIG. 10. The female closure element 1030 includes two spring members 1044, 1078 that extend from a base portion 1034 of female closure element 1030. The spring members 1044, 1078 extend away from one another. The male closure element 1032 is the same as the male closure element 932 disclosed in FIG. 22. Similar to FIG. 22, the male closure element 1032 in this embodiment includes two spring members 1082, 1084 that extend from a base portion 1050. The spring members 1082, 1084 extend away from one another. In another configuration of this embodiment, the spring members 1082, 1084 of the male closure element 1032 may be adapted to extend toward one another. This other embodiment would have a male closure element 1032 similar to the male closure element 832, illustrated in FIGS. 20 and 21.

Figure 26:
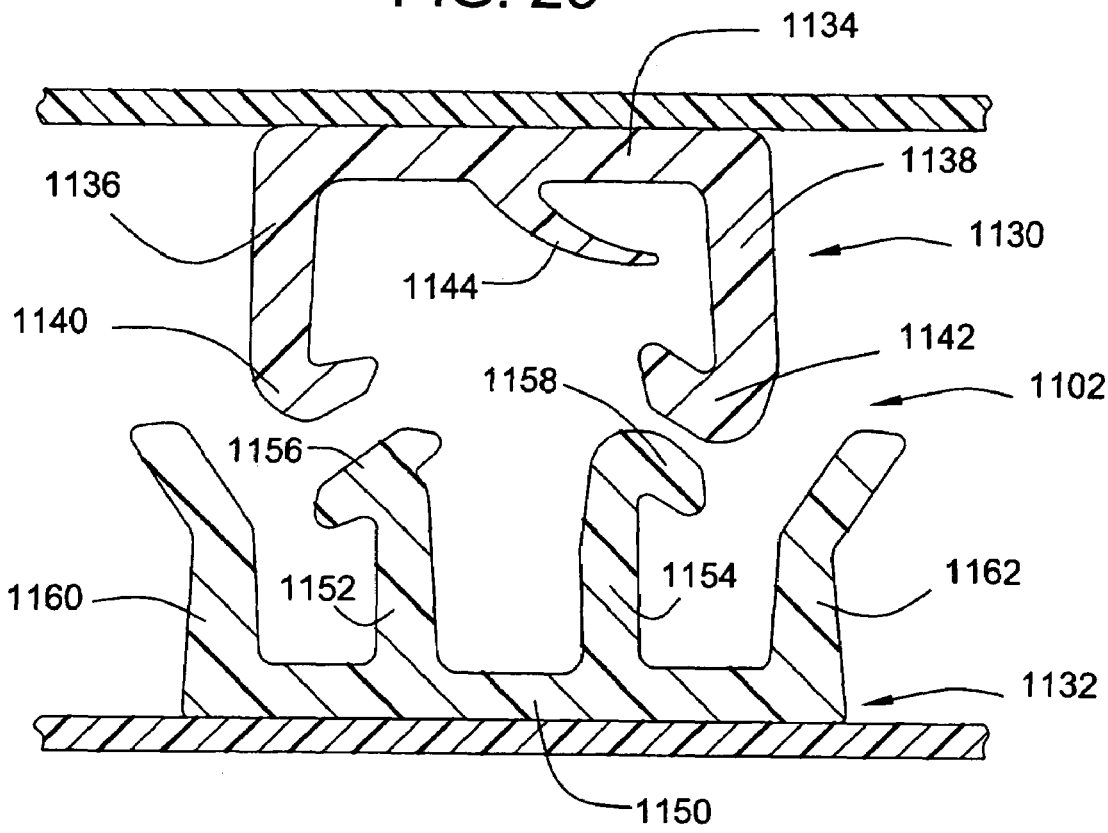
FIG. 26 is a cross-sectional view of another embodiment of the closure device, shown in a non-occluded position.

FIG. 26 illustrates another embodiment of the present invention, shown in a non-occluded position. This embodiment is similar to the embodiment disclosed in FIG. 2. In this embodiment, the female closure element 1130 is substantially the same as the female closure element 130 illustrated in FIG. 2. Female closure element 1130 includes a base portion 1134, a spring member 1144 and a pair of spaced-apart, parallely disposed webs 1136, 1138. The spring member 1144 and webs 1136, 1138 extend from base portion 1134.

The male closure element 1132 is similar to the male closure element 132 disclosed in FIG. 2. The male closure element 1132 includes a base portion 1150, a pair of spaced-apart, parallely disposed guide wings 1160, 1162 and a pair of spaced-apart, parallely disposed webs 1152, 1154. The guide wings 1160, 1162 and webs 1152, 1154 extend from the base portion 1150.

Figure 27:
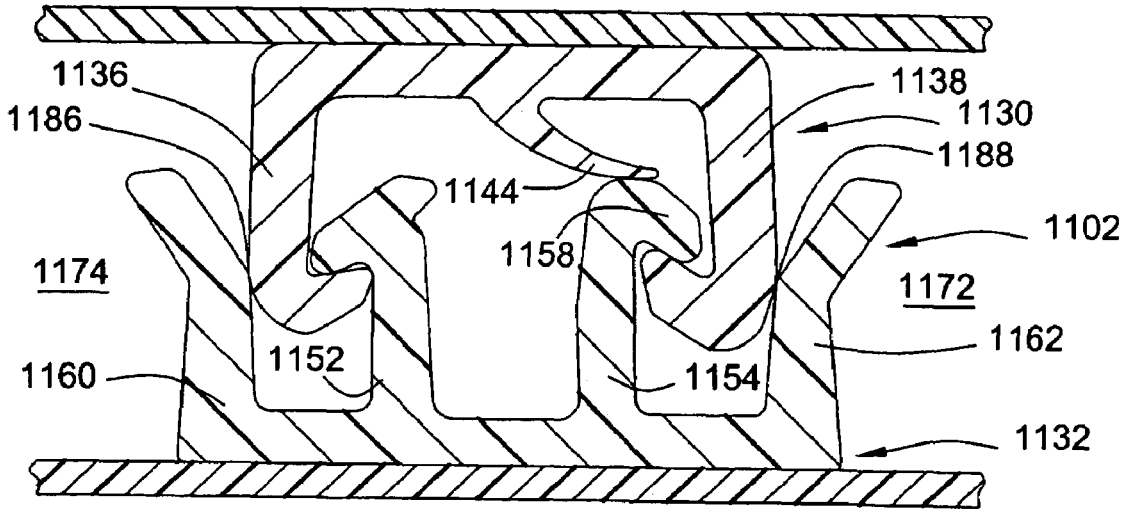
FIG. 27 is a cross-sectional view of the closure device of FIG. 26, shown in an occluded position.

Best illustrated in FIG. 27, the difference between this embodiment and the embodiment disclosed in FIG. 2 is that the guide wings 1160, 1162 and the webs 11136, 1138, in this embodiment, are adapted such that the guide wings 1160, 1162 contact and act upon a portion of the webs 1136, 1138 of the female closure element 1130. The guide wing 1160, which is disposed adjacent to the exterior 1174 of a container acts upon web 1136 at contact surface 1186. The guide wing 1162 which is disposed adjacent to the interior 1172 of a container acts upon web 1138 at contact surface 1188. As a result, webs 1136, 1138 of the female closure element 1130 are laterally pressed against webs 1152, 1154 of the male closure element 1132, respectively.

While in the occluded position, the sealing action of the closure device 1102 increases by having the guide wings 1160, 1162 act upon webs 1136, 1138. The additional contact surfaces 1186, 1188 provide additional seals. Additionally, the seal between interlocking web 1136 and web 1152 improves because of the increased pressure between the two members. For the same reasons, the seal between interlocking web 1138 and web 1154 improves.

Figure 28:
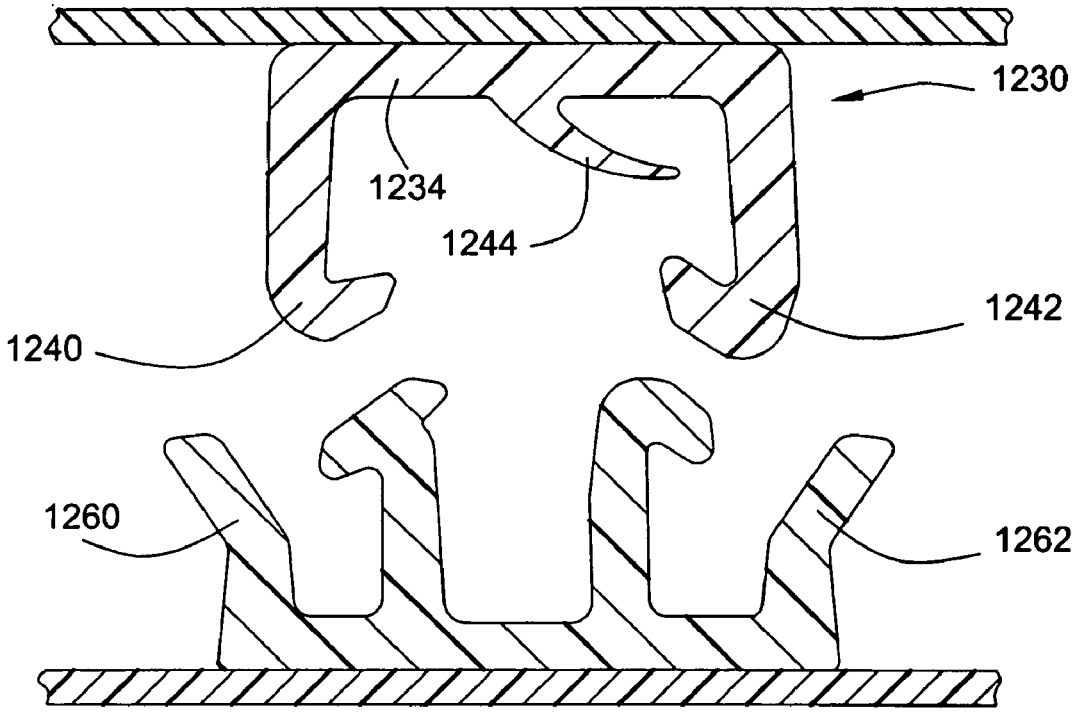
FIG. 28 is a cross-sectional view of another embodiment of the closure device, shown in a non-occluded position.
Figure 29:
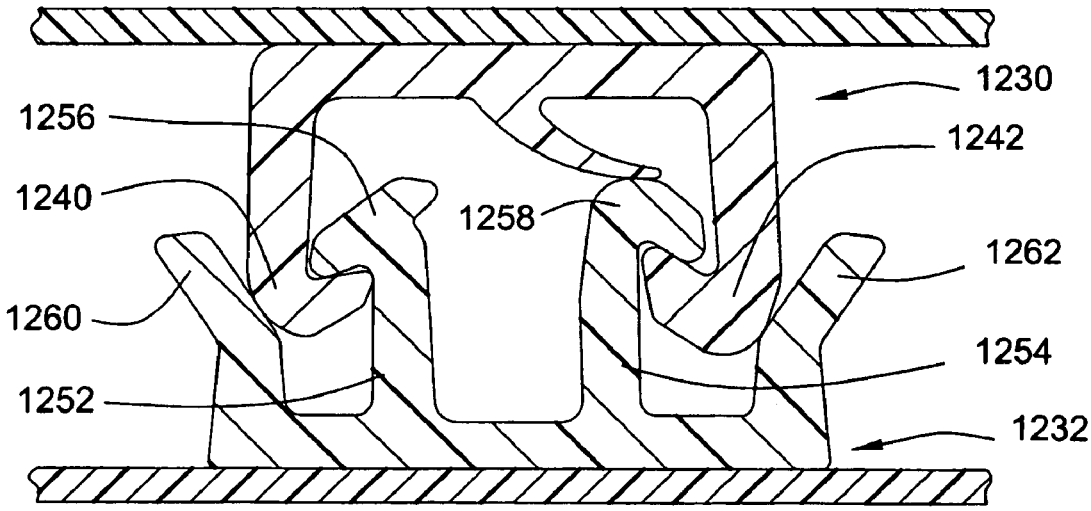
FIG. 29 is a cross-sectional view of the closure device of FIG. 28, shown in an occluded position.

FIGS. 28 and 29 illustrate an additional embodiment, shown in a non-occluded and occluded position, respectively. This embodiment is substantially similar to the embodiment disclosed in FIGS. 26 and 27. This embodiment similarly includes a spring member 1244 that extends from the base portion 1234 of the female closure element 1230. As best illustrated in FIG. 29, the primary difference between the two embodiments is that the guide wings 1260, 1262 of this embodiment are adapted to act primarily upon the female hook portions 1240, 1242 of the female closure element 1230. By acting upon the female hook portions 1240, 1242, the female hook portions may be pressed against male hook portions 1256, 1258 at an angle rather than laterally. To establish this feature, the guide wings 1260, 1262, of this embodiment, may be shorter, disposed closer to webs 1252, 1254, or a combination thereof as compared to the guide wings 1160, 1162 of the embodiment disclosed in FIGS. 26 and 27.

Figure 30:
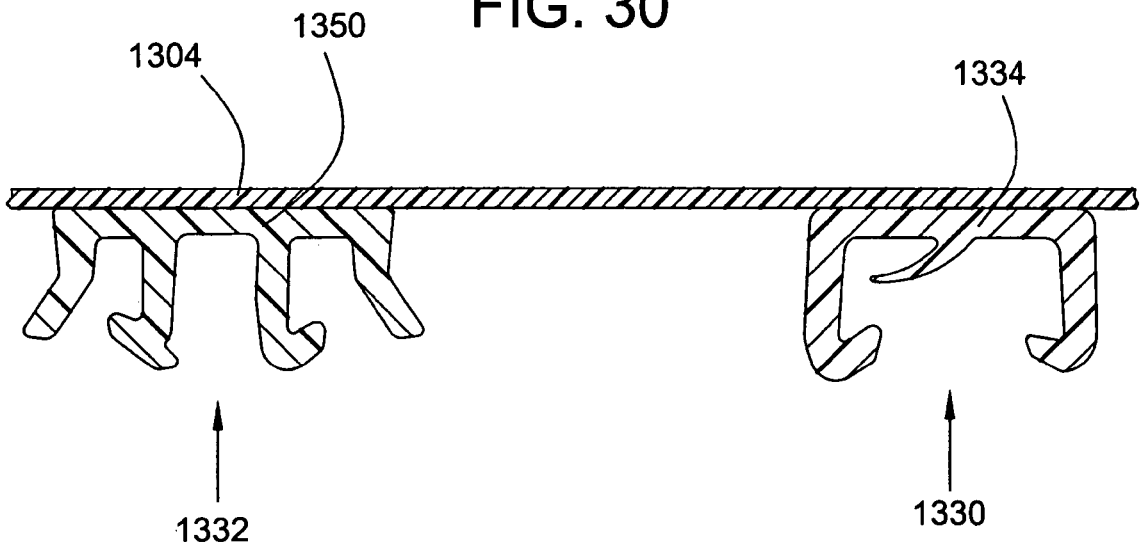
FIG. 30 is a cross-sectional view of a closure device in accordance with the invention, wherein male and female closure elements are on the same side of a film.

FIG. 30 generally illustrates the positioning of the female and male closure elements 1330, 1332 with respect to a film 1304 that defines a container. The female and male closure elements 1330, 1332 include base portions 1334, 1350, respectively. The base portions 1334, 1350 attach the female and male closure elements 1330, 1332, respectively, to the same side of the film 1304. This is the typical arrangement of the female and male closure elements 1330, 1332. This arrangement results in a container as illustrated in FIG. 1. It should be noted, that in certain embodiments of the invention, unlike the illustrated embodiment, the female and male closure elements 1330, 1332 may be integrally formed with the film 1304. In that configuration, the film 1304, female closure element 1330, and male closure element 1332 would integrally form a unitary body.

Figure 31:
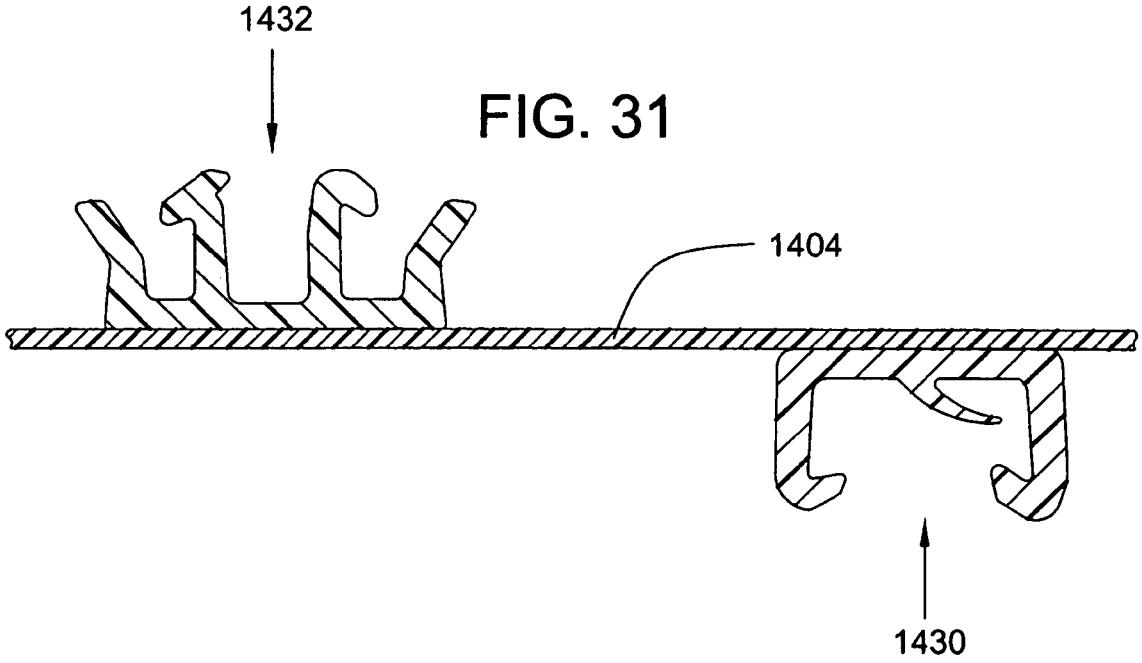
FIG. 31 is a cross-sectional view of a closure device in accordance with the invention, wherein male and female closure elements are on opposite sides of a film.

FIG. 31 illustrates a variation of the arrangement in FIG. 30. In this embodiment, the female and male closure elements 1430, 1432 are positioned on opposite sides of a film 1404. This configuration can be used to electrically insulate wires or bind together a group of wires. Furthermore, because the female and male closure elements 1430, 1432 provide a sealed closure, this configuration can be used to form a flexible straw.

Figure 32:
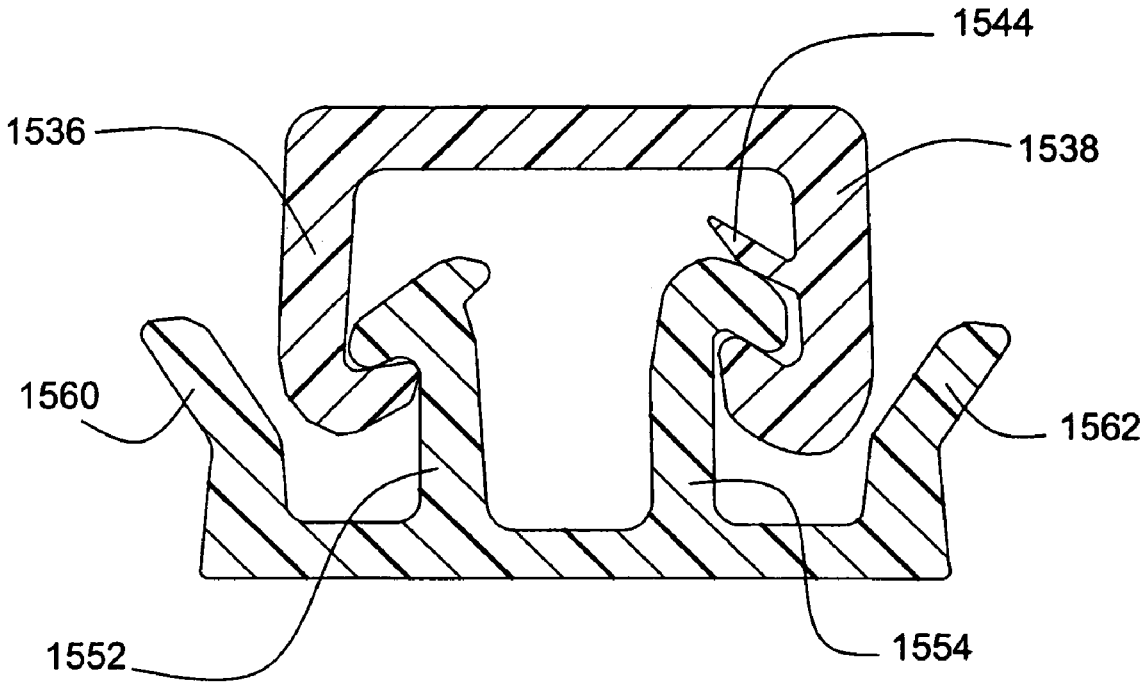
FIG. 32 is a cross-sectional view of another embodiment of the closure device.
Figure 33:
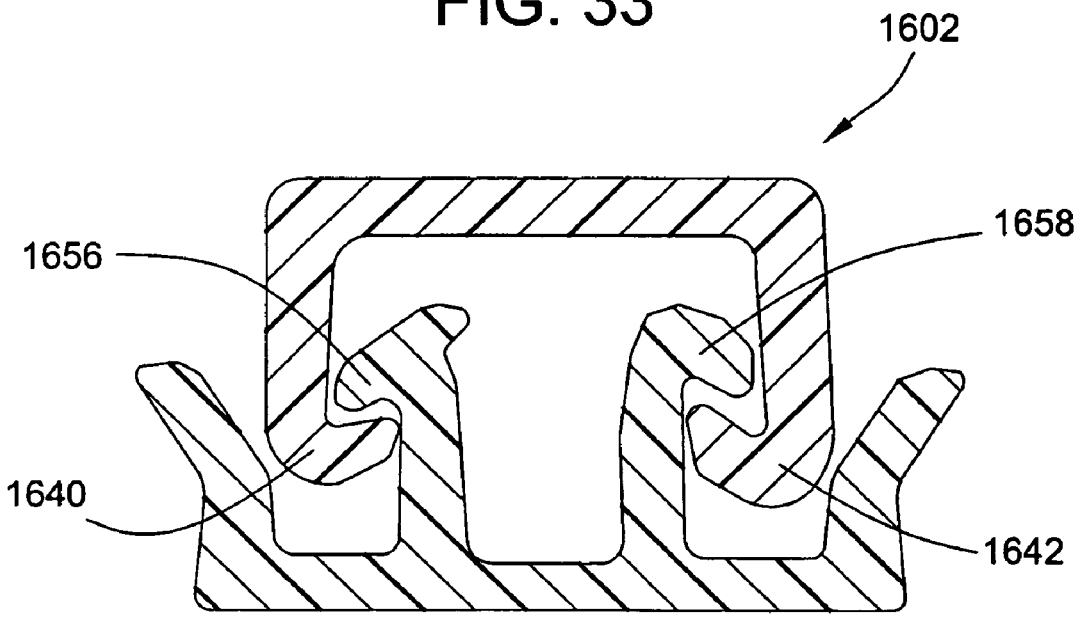
FIG. 33 is a cross-sectional view of a closure device wherein the hooks are not contacting each other.

The spring member may also be located on the webs. Referring to FIG. 32, the spring member 1544 is located on web 1538 and extends inwardly from the web 1538. In this embodiment, the spring member 1544 extends in a substantially horizontal direction and substantially perpendicular to the web 1538. In this embodiment, the spring member 1544 engages the hook portion 1558 as shown in FIG. 32. In other embodiments, the spring member may extend at other angles relative to the web and may extend inwardly or outwardly from the web. In addition, the spring member may be located on other webs, such as, webs 1536, 1552, 1554 or the guide wings 1560, 1562 or combinations thereof or in combination with other embodiments disclosed herein.

The spring member may be used with other closure devices or fastening strips. For example, the spring member may be used with: "arrowhead-type" or "rib and groove" fastening strips as described in U.S. Pat. No. 3,806,998; "profile" fastening strips as described in U.S. Pat. No. 5,664,299; or "rolling action" fastening strips as described in U.S. Pat. No. 5,007,143.

Figure 34:
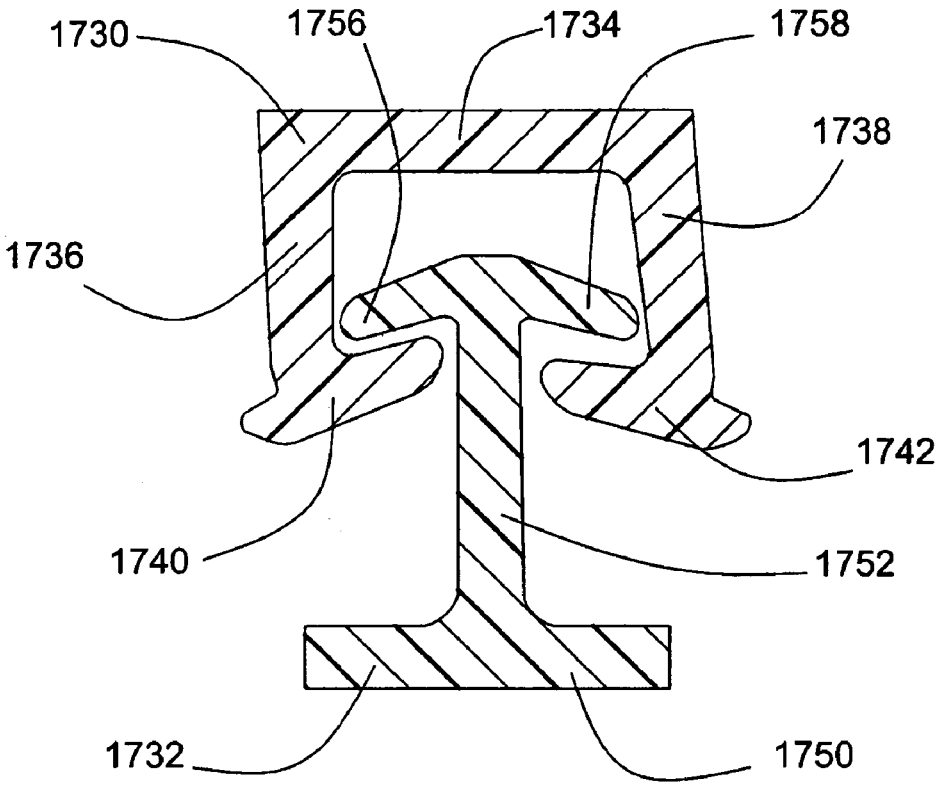
FIG. 34 is a cross-sectional view of a closure device wherein the fit is loose.

For example, the interlocking fastening strips may comprise "arrowhead-type" or "rib and groove" fastening strips as described in U.S. Pat. No. 3,806,998 and a variation shown in FIG. 34. Referring to FIG. 34, the female fastening strip 1736 may include a base 1734, webs 1736, 1738 and hook portions 1740, 1742. The male fastening strip 1732 may include a base 1750, a web 1752, and hook portions 1756, 1758. In FIG. 34, the fastening strips 1732, 1736 are loose such that the hook portions 1740, 1742, 1756, 1758 are not in contact with each other. In other embodiments, the fastening strips may have an appearance more similar to the fastening strips described in U.S. Pat. No. 3,806,998.

Figure 35:
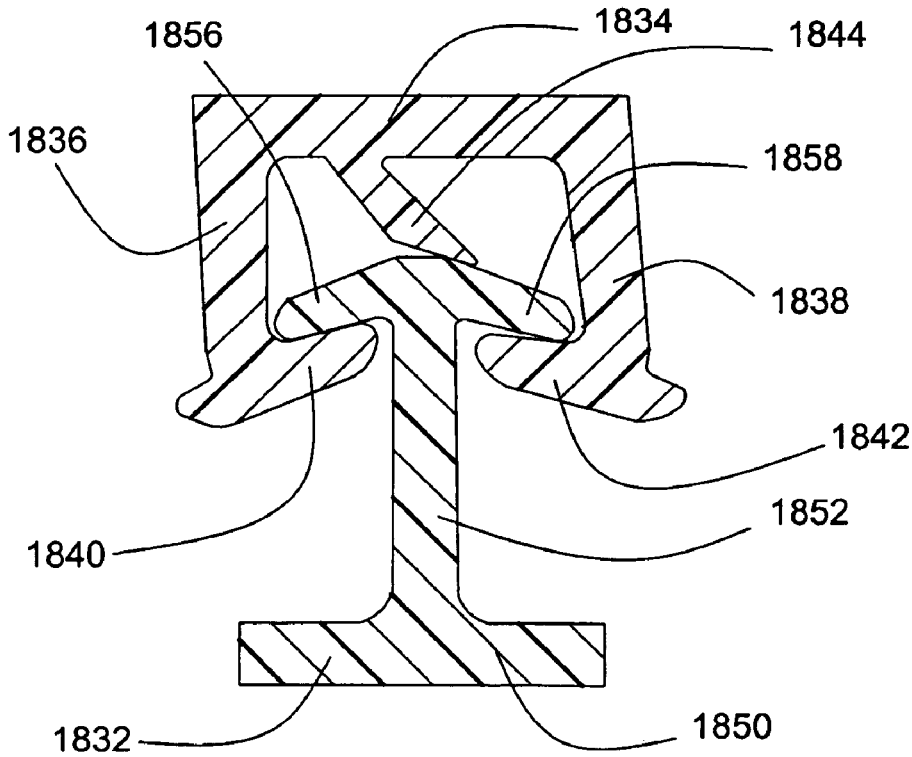
FIG. 35 is a cross-sectional view of another embodiment of a closure device.

Referring to FIG. 35, the fastening strips may include a spring member 1844. In this embodiment, the spring member 1844 is located on the base 1834 and acts upon the hook 1858. The spring member 1844 causes the hook portions to contact each other and create a better seal. In other embodiments, the spring member 1844 may be located on either fastening strip or both fastening strips. Also, in other embodiments, the spring member may be located at other locations, such as, the webs 1836, 1838, 1852, or the base 1850.

The closure devices can be manufactured in a variety of forms to suit the intended use. The closure devices may be connected to a container by the use of any of many known methods. For example, a thermoelectric device may be applied to a film in contact with the male and female closure elements of the closure device to cause a transfer of heat through the film to produce melting at the interface of the film and the base portions of the closure elements. Suitable thermoelectric devices include heated rotary discs, traveling heater bands, resistance-heated slide wires, and the like. The connection between the film and the male and female closure elements may also be established by the use of hot melt adhesives, hot jets of air to the interface, ultrasonic heating, or other known methods. The bonding of the male and female closure elements to the film stock may be carried out either before or after the film is U-folded to form the bag. In any event, such bonding is done prior to side sealing the bag at the edges by conventional thermal cutting. The male and female closure elements would usually be positioned on the film in a generally parallel relationship with respect to each other, although this will depend on the intended use.

It should be noted that the illustrated arrangements in FIGS. 30 and 31 may be applied to all disclosed embodiments of the invention.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A closure device for a flexible resealable leak proof container defining an interior and exterior, the closure device comprising:

a male longitudinally extending closure element, the male closure element includes a base portion and a pair of spaced-apart webs extending therefrom, each male web including and terminating in a respective male hook portion, the male base portion, webs and hook portions being integrally formed in one piece, the male hook portions facing away from one another;

a female longitudinally extending closure element adapted to interlockingly engage the male closure element over a predetermined length, the female closure element includes a base portion and a pair of spaced-apart webs extending therefrom, each female web including and terminating in a respective female hook portion, the female base portion, webs and hook portions being integrally formed in one piece, the female hook portions extending toward one another, the female hook portions adapted to engage and mate with the male hook portions when the closure device is fully occluded; and at least one spring member extending from and integrally formed in one piece with the base portion of at least one of the closure elements, the at least one spring member including a free end that acts directly on at least one of the hook portions of the other closure element when the closure device is fully occluded.

2. The closure device of claim 1, wherein the at least one spring member is integrally attached to the base portion of the female closure element and the at least one spring member acts upon at least one of the male hook portions.

3. The closure device of claim 2, wherein the at least one spring member includes two spring members.

4. The closure device of claim 3, wherein the two spring members extend away from one another.

5. The closure device of claim 3, wherein the two spring members extend toward one another.

6. The closure device of claim 2, wherein the spring member is attached between the pair of female hook portions.

7. The closure device of claim 1, wherein the at least one spring member is integrally attached to the base portion of the male closure element and the at least one spring member acts upon at least one of the female hook portions.

8. The closure device of claim 7, wherein the at least one spring member includes two spring members.

9. The closure device of claim 8, wherein the two spring members extend away from one another.

10. The closure device of claim 8, wherein the two spring members extend toward one another.

11. The closure element of claim 7, wherein the pair of webs of the male closure element comprises a first web and a second web, the first web having a first side and a second side, the second web having a first side and a second side, the second side of the first web and the second side of the second web being adjacent to one another, the at least one spring member being disposed adjacent to the first side of the first web.

12. The closure element of claim 7, wherein the pair of webs of the male closure element comprises a first web and a second web, the first web having a first side and a second side, the second web having a first side and a second side, the second side of the first web and the second side of the second web being adjacent to one another, the at least one spring member being disposed adjacent to the first side of the second web.

13. The closure device of claim 1, wherein the male closure element includes a pair of spaced-apart, parallely disposed guide wings that integrally attach to and extend from the base portion, the guide wings being adapted to guide the female hook portions and webs of the female closure element during occlusion of the closure device.

14. The closure device of claim 13, wherein the guide wings act upon the webs of the female closure element when in a fully occluded position.

15. The closure device of claim 13, wherein the guide wings act upon the female hook portions of the female closure element when in a fully occluded position.

16. The closure device of claim 13, wherein the at least one spring member is attached to the base portion of the male closure element between the guide wing and web of the male closure element adjacent the exterior of the container and acts upon at least one of the female hook portions.

17. The closure device of claim 13, wherein the at least one spring member is attached to the base portion of the male closure element between the guide wing and web of the male closure element adjacent the interior of the container and acts upon at least one of the female hook portions.

18. The closure device of claim 13, wherein the at least one spring member comprises at least three spring members, at least one of the at least three spring members is attached to the female closure element between the female hook portions, at least one of the at least three spring members is attached to the male closure element between the guide wing and web adjacent the exterior of the container, and at least one of the at least three sprig members is attached to the male closure element between the guide wing and web adjacent the interior of the container.

19. The closure device of claim 1, wherein the at least one spring member is curved.

20. The closure device of claim 1, wherein the at least one spring member comprises at least two spring members, at least one of the at least two spring members is attached to the male closure element, and at least one of the at least two spring members is attached to the female closure element.

21. The closure device of claim 1, wherein the at least one spring member comprises at least two spring members, at least one of the at least two spring members is attached to the male closure element, and at least one of the at least two spring members is attached to the female closure element.

22. The closure device of claim 1 wherein the at least one spring member is a straight member.

23. A flexible resealable leak proof container that defines an interior and exterior, the container comprising:

a thin film defining first and second sidewalls;

a closure device, the closure device further comprising male and female longitudinally extending closure elements adapted to interlockingly engage one another over a predetermined length, the male closure element includes a base portion and a pair of spaced-apart webs extending therefrom, each male web including and terminating in a respective male hook portion, the male base portion, webs and hook portions being integrally formed in one piece, the male hook portions facing away from one another, the female closure element includes a base portion and a pair of spaced-apart webs extending therefrom, each female web including and terminating in a respective female hook portion, the female base portion, webs and hook portions being integrally formed in one piece, the female hook portions extending toward one another and adapted to engage and mate with the male hook portions when the closure device is fully occluded, thereby defining an interior and exterior of the container, and at least one spring member extending from and being integrally formed in one piece with the base portion of one of the male or female closure elements, the at least one spring member including a free end that acts directly on at least one of the hook portions of the other closure element when the closure device is fully occluded.

24. The container of claim 23, wherein the at least one spring member is integrally attached to the base portion of the female closure element and the at least one spring member acts upon at least one of the male hook portions when the closure device is in the occluded position.

25. The container of claim 24, wherein the at least one spring member includes two spring members.

26. The container of claim 25, wherein one spring member extends toward the interior of the container and acts upon the male hook portion adjacent the interior of the container, and one spring member extends toward the exterior of the container and acts upon the male hook portion adjacent the exterior of the container.

27. The container of claim 25, wherein the two spring members are attached between the pair of female hook portions.

28. The container of claim 24, wherein the at least one spring member extends toward the interior of the container and acts upon to the male hook portion adjacent to the interior of the container.

29. The container of claim 24, wherein the at least one spring member extends toward the exterior of the container and acts upon the male hook portion adjacent the exterior of the container.

30. The container of claim 24, wherein the spring member attached between the pair of female hook portions.

31. The container of claim 23, wherein the at least one spring member is integrally attached to the base portion of the male closure element and the at least one spring member acts upon at least one of the female hook portions when the closure device is in the occluded position.

32. The container of claim 31, wherein the at least one spring member includes two spring members.

33. The container of claim 32, wherein one spring member extends toward the interior of the container and acts upon the female hook portion adjacent the interior of the container and one spring member extends toward the exterior of the container and acts upon the female hook portion adjacent the exterior of the container.

34. The container of claim 32, wherein one spring member extends toward the exterior of the container and acts upon the female hook portion near the interior of the container and one spring member extends toward the interior of the container and acts upon the female hook portion near the exterior of the container.

35. The container of claim 31, wherein the at least one spring member extends toward the interior of the container and acts upon the female hook portion adjacent the interior of the container.

36. The container of claim 31, wherein the at least one spring member extends toward the interior of the container and acts upon the female hook portion adjacent the exterior of the container.

37. The container of claim 31, wherein the at least one spring member extends toward the exterior of the container and acts upon the female hook portion adjacent the interior of the container.

38. The container of claim 31, wherein the at least one spring member extends toward the exterior of the container and acts upon the female hook portion adjacent the exterior of the container.

39. The container of claim 31, wherein the pair of webs of the male closure element comprises a first web and a second web, the first web having a first side and a second side, the second web having a first side and a second side, the second side of the first web and the second side of the second web being adjacent to one another, the at least one spring member being disposed adjacent to the first side of the first web.

40. The container of claim 31, wherein the pair of webs of the male closure element comprises a first web and a second web, the first web having a first side and a second side, the second web having a first side and a second side, the second side of the first web and the second side of the second web being adjacent to one another, the at least one spring member being disposed adjacent to the first side of the second web.

41. The container of claim 23, wherein the male closure element includes a pair of spaced-apart, parallely disposed guide wings integrally attached thereto and extending therefrom, the guide wings being adapted to guide the webs of the female closure element during occlusion.

42. The container of claim 41, wherein the guide wings act upon the webs of the female closure element when in an occluded position.

43. The container of claim 41, wherein the guide wings act upon the female hook portions of the female closure element when in an occluded position.

44. The container of claim 41, wherein the at least one spring member is attached to the base portion of the male closure element between the guide wing and web of the male closure element adjacent the exterior of the container and acts upon at least one of the female hook portions.

45. The container of claim 41, wherein the at least one spring member is attached to the base portion of the male closure element between the guide wing and web of the male closure element adjacent the interior of the container and the acts upon at least one of the female hook portions.

46. The container of claim 23, wherein the male and female closure elements are connected to the film, the film extending between the closure elements.

47. The container of claim 46, wherein the closure elements are positioned on the same side of the film.

48. The container of claim 46, wherein the closure elements are positioned on opposite sides of the film.

49. The container of claim 46, wherein the closure elements are integrally attached to the film.

50. The container of claim 23, wherein the at least one spring member is curved.

51. The container of claim 23, wherein the at least one spring member comprises at least two spring members, at least one of the at least two spring members is attached to the male closure element, and at least one of the at least two spring members is attached to the female closure element.

52. The container of claim 23, wherein the at least one spring member comprises at least four spring members, at least two of the at least four spring members are attached to the male closure element, and at least two of the at least four spring members are attached to the female closure element.

53. The container of claim 23, wherein the at least one spring member comprises at least three spring members, at least two of the at least three spring members are attached to the male closure element, and at least one of the at least three spring members is attached to the female closure element.

54. The container of claim 23, wherein the at least one spring member comprises at least three spring members, one of the at least three spring members is attached to the male closure element, and at least two of the at least three spring members are attached to the female closure element.

55. The container of claim 23, wherein the at least one spring member is a straight member.

56. A method of manufacturing a closure device, comprising:

providing a male longitudinally extending closure element, the male closure element including a base portion and a pair of spaced-apart webs extending therefrom, each male web further including and terminating in a respective male hook portion, the male base portion, webs and hook portions being integrally formed in one piece the male hook portions facing away from one another;

providing a female longitudinally extending closure element adapted to interlockingly engage the male closure element over a predetermined length, the female closure element including a base portion and a pair of spaced-apart webs extending therefrom, each female web further including and terminating in a respective female hook portion, the female base portion, webs and hook portions being integrally formed in one piece, the female hook portions extending toward one another, the female hook portions adapted to engage and mate with the male hook portions when the closure device is fully occluded; and providing at least one spring member extending from and being integrally formed in one piece with the base portion of at least one of the closure elements, the at least one spring member including a free end that acts directly upon at least one of the hook portions of the other closure element when the closure device is fully occluded.

57. The method of claim 56, further providing a thin film and attaching the male and female closure elements to the thin film, wherein the thin film extends between the closure elements.

58. The method of claim 56, wherein the thin film, the spring member and the male and female closure elements are provided in an integrally formed unitary body.

59. A closure device for a flexible resealable leak proof container defining an interior and an exterior, the closure device comprising:

a male longitudinally extending closure element, the male closure element includes a base portion and a pair of spaced-apart webs extending therefrom, each male web including and terminating in a respective male hook portion, the male base portion, webs and hook portions being integrally formed in one piece, the male hook portions facing away from one another;

a female longitudinally extending closure element adapted to interlockingly engage the male closure element over a predetermined length, the female closure element includes a base portion and a pair of spaced-apart webs extending therefrom, each female web including and terminating in a respective female hook portion, the female base portion, webs and hook portions being integrally formed in one piece, the female hook portions extending toward one another, the female hook portions adapted to engage and mate with the male hook portions when the closure device is fully occluded; and at least one spring member extending from and integrally formed in one piece with the web portion of at least one of the closure elements, the at least one spring member including a free end that acts directly on at least one of the hook portions of the other closure element when the closure device is fully occluded.

* * * * *